US009268301B2

(12) United States Patent
Sakuma et al.

(10) Patent No.: US 9,268,301 B2
(45) Date of Patent: Feb. 23, 2016

(54) IMAGE FORMING APPARATUS HAVING HOUSING FORMED WITH OPENING AND PROCESS CARTRIDGE MOUNTED IN THE HOUSING

(71) Applicant: Brother Kogyo Kabushiki Kaisha, Nagoya-shi, Aichi-ken (JP)

(72) Inventors: Susumu Sakuma, Kasugai (JP); Yasumasa Fujii, Anjo (JP); Hiroki Mori, Nagoya (JP); Saya Minoshima, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,281

(22) Filed: Jan. 9, 2015

(65) Prior Publication Data

US 2015/0125178 A1 May 7, 2015

Related U.S. Application Data

(63) Continuation-in-part of application No. PCT/JP2012/080836, filed on Nov. 29, 2012.

(30) Foreign Application Priority Data

Jul. 9, 2012 (JP) ..... 2012-154145

(51) Int. Cl.
*G03G 21/18* (2006.01)
*G03G 21/16* (2006.01)

(52) U.S. Cl.
CPC ..... *G03G 21/1814* (2013.01); *G03G 21/1676* (2013.01); *G03G 21/18* (2013.01)

(58) Field of Classification Search
CPC ..... G03G 21/1814; G03G 21/1846
See application file for complete search history.

(56) References Cited

U.S. PATENT DOCUMENTS 5,606,406 A 2/1997 Ikeyama et al.
5,930,561 A 7/1999 Hosokawa et al.

(Continued)

FOREIGN PATENT DOCUMENTS

JP H03-021978 A 1/1991
JP H04-067967 A 3/1992

(Continued)

OTHER PUBLICATIONS

Jan. 22, 2015—International Preliminary Report on Patentability—Intl App PCT/JP2012/080836.

(Continued)

*Primary Examiner* — Gregory H Curran
(74) *Attorney, Agent, or Firm* — Banner & Witcoff, Ltd.

(57) ABSTRACT

An image forming apparatus includes: a housing; and a process cartridge. The housing is formed with a first opening through which recording medium is to be introduced into an inside of the housing. The process cartridge is configured to be mounted in the inside of the housing and is provided with a photosensitive body. The process cartridge is provided with a process cartridge holding part configured to be held by a user so as to remove the process cartridge from the housing. The process cartridge holding part is configured such that in a state where the process cartridge is mounted in the inside of the housing, the process cartridge holding part prevents at least part of light that has entered the inside of the housing through the first opening from reaching the photosensitive body.

19 Claims, 9 Drawing Sheets

(56) References Cited

U.S. PATENT DOCUMENTS

| | | | | |
|---|---|---|---|---|
| 6,681,088 | B2 | 1/2004 | Kanno et al. | |
| 7,805,097 | B2 | 9/2010 | Mase et al. | |
| 7,953,339 | B2 | 5/2011 | Fukamachi et al. | |
| 8,571,445 | B2 | 10/2013 | Komatsu et al. | |
| 8,886,081 | B2 | 11/2014 | Yokota | |
| 2007/0274752 | A1 | 11/2007 | Imaizumi | |
| 2008/0181661 | A1 | 7/2008 | Mase et al. | |
| 2008/0199204 | A1 | 8/2008 | Ishii et al. | |
| 2008/0212993 | A1 | 9/2008 | Ishii et al. | |
| 2008/0240774 | A1 | 10/2008 | Fukamachi et al. | |
| 2010/0278559 | A1 | 11/2010 | Komatsu et al. | |
| 2012/0070185 | A1 | 3/2012 | Yokota | |
| 2012/0328324 | A1 * | 12/2012 | Chadani et al. | 399/103 |
| 2014/0112685 | A1 | 4/2014 | Komatsu et al. | |
| 2015/0160607 | A1 | 6/2015 | Takagi et al. | |

FOREIGN PATENT DOCUMENTS

| | | | |
|---|---|---|---|
| JP | H06-110264 | A | 4/1994 |
| JP | H06-148967 | A | 5/1994 |
| JP | H10-074032 | | 3/1998 |
| JP | H10-143031 | A | 5/1998 |
| JP | H10-333531 | A | 12/1998 |
| JP | 2001-022250 | A | 1/2001 |
| JP | 2001-242767 | A | 9/2001 |
| JP | 2004-224507 | A | 8/2004 |
| JP | 2005-099380 | A | 4/2005 |
| JP | 2008-185827 | A | 8/2008 |
| JP | 2008-203566 | A | 9/2008 |
| JP | 2008-249802 | A | 10/2008 |
| JP | 2008-276138 | A | 11/2008 |
| JP | 2010-262056 | A | 11/2010 |
| JP | 2011-100006 | A | 5/2011 |
| JP | 2012-068371 | A | 4/2012 |

OTHER PUBLICATIONS

Jan. 22, 2015—International Preliminary Report on Patentability—Intl App PCT/JP2012/080828.

Jun. 19, 2015—(US) Non-Final Office Action—U.S. Appl. No. 14/593,366.

Dec 16, 2015—(US) Notice of Allowance—U.S. Appl. No. 14/593,366.

Dec 15, 2015—(JP) Office Action—App 2012-154136.

Dec 8, 2015—(JP) Office Action—App 2012-154145.

* cited by examiner

IMAGE FORMING APPARATUS HAVING HOUSING FORMED WITH OPENING AND PROCESS CARTRIDGE MOUNTED IN THE HOUSING

CROSS REFERENCE TO RELATED APPLICATION

This application claims priority from Japanese Patent Application No. 2012-154145 filed Jul. 9, 2012. This application is also a continuation-in-part of International Application No. PCT/JP2012/080836 filed Nov. 29, 2012 in Japan Patent Office as a Receiving Office. The entire contents of both applications are incorporated herein by reference.

TECHNICAL FIELD

The present invention relates to an image forming apparatus of an electrophotographic type.

BACKGROUND

As an electrophotographic image forming apparatus, there is known a printer provided with an apparatus body and a process cartridge removably mounted in the apparatus body.

As an example of such a printer, Japanese Patent Application Publication No. 2004-224507 has proposed a printer, in which the apparatus body is formed with an opening for introducing sheets such as recording papers and in which the process cartridge accommodates toner and supports a photosensitive drum.

In the printer having the above-described configuration, during an image forming process, an electrostatic latent image is formed on the peripheral surface of the photosensitive drum, and toner is supplied to the electrostatic latent image, whereby a visible image (developer image) is carried on the peripheral surface of the photosensitive drum.

SUMMARY

However, in the printer of the above-described Japanese publication, light may enter the apparatus body from the opening, and the entered light may reach the photosensitive drum in the process cartridge mounted in the apparatus body.

In this case, the peripheral surface of the photosensitive drum may be exposed to undesired light so as to be deteriorated. If the peripheral surface of the photosensitive drum is exposed to undesired light during the image forming process, this exposure may change the electric potential on the peripheral surface of the photosensitive drum at regions on and around the electrostatic latent image, and cause defective image formation.

To cope with this problem, such a configuration is conceivable in which a light shielding member for blocking light is provided inside the apparatus body to suppress light that has entered the apparatus body from reaching the photosensitive drum.

However, in such a conceivable configuration, a space for providing the light shielding member needs to be ensured inside the apparatus body, limiting downsizing of the printer.

An object of the present invention is therefore to provide an image forming apparatus capable of suppressing deterioration of a photosensitive body, suppressing occurrence of defective image formation, and achieving downsizing of the image forming apparatus.

In view of the foregoing, it is an object of the invention to provide an image forming apparatus which may include: a housing; and a process cartridge. The housing may be formed with a first opening through which recording medium is to be introduced into an inside of the housing. The process cartridge may be configured to be mounted in the inside of the housing and may be provided with a photosensitive body. The process cartridge may be provided with a process cartridge holding part configured to be held by a user so as to remove the process cartridge from the housing. The process cartridge holding part may be configured such that in a state where the process cartridge is mounted in the inside of the housing, the process cartridge holding part prevents at least part of light that has entered the inside of the housing through the first opening from reaching the photosensitive body.

According to another aspect, the present invention provides an image forming apparatus which may include: a housing; a developer accommodating cartridge; and a photosensitive body. The housing may be formed with a first opening through which recording medium is to be introduced into an inside of the housing. The developer accommodating cartridge may be configured to be mounted in the inside of the housing and to accommodate developer. The photosensitive body may be provided in the inside of the housing. The developer accommodating cartridge may be provided with a developer-accommodating cartridge holding part configured to be held by a user so as to remove the developer accommodating cartridge from the housing. The developer-accommodating cartridge holding part may be configured such that in a state where the developer accommodating cartridge is mounted in the inside of the housing, the developer-accommodating cartridge holding part prevents at least part of light that has entered the inside of the housing through the first opening from reaching the photosensitive body.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
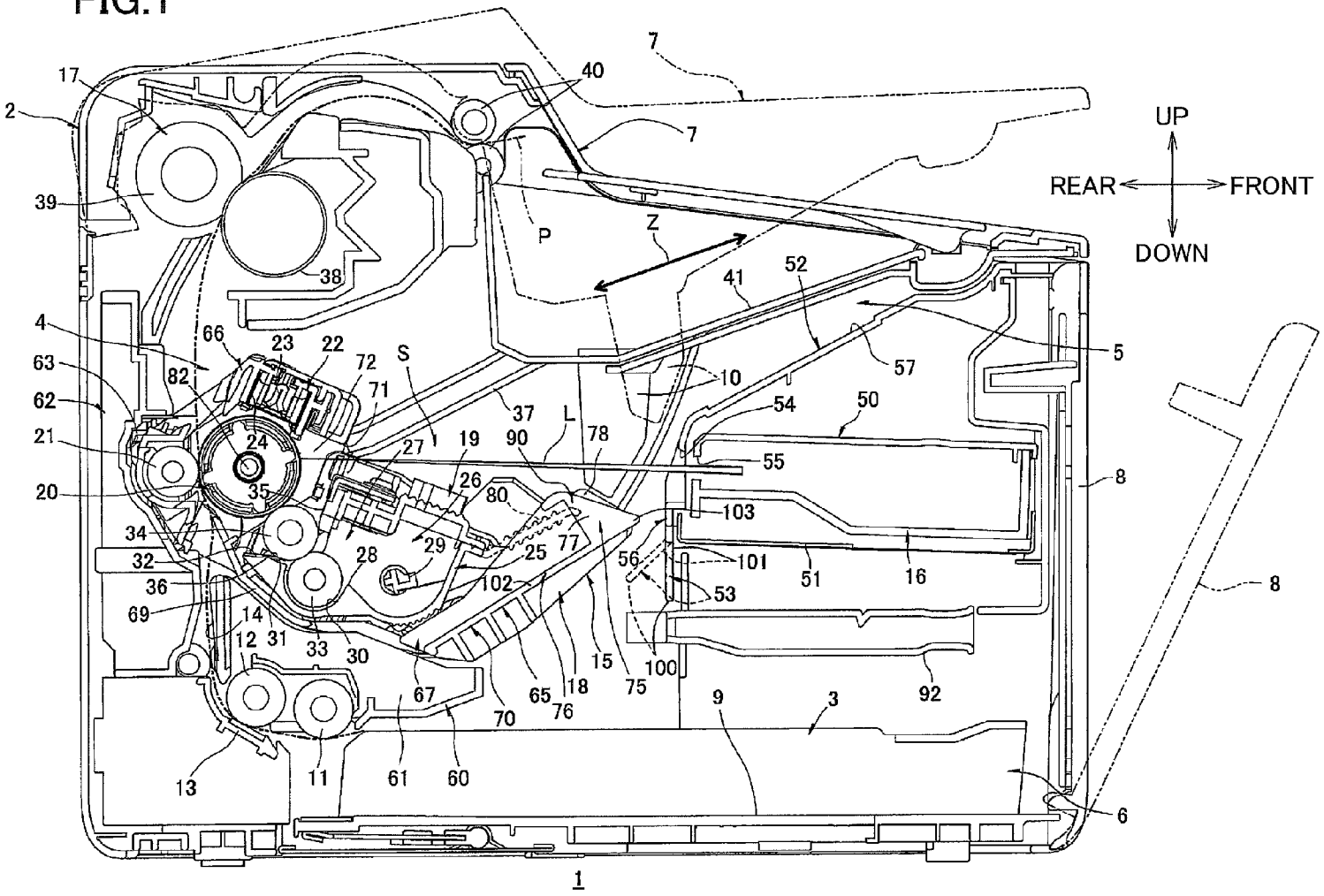
FIG. 1 is a cross-sectional side view of a printer according to a first embodiment of the present invention, in which a sheet-feeding cover is in a first position.

An image forming apparatus according to embodiments of the invention will be described while referring to the accompanying drawings wherein like parts and components are designated by the same reference numerals to avoid duplicating description.

1. Overall Configuration of Printer

FIG. 1 shows a printer 1 serving as an example of an image forming apparatus according to a first embodiment of the present invention. The printer 1 is provided with a main casing 2 as an example of a housing.

The main casing 2 is box-shaped. The main casing 2 accommodates therein a sheet-feeding unit 3 for feeding sheets P of paper which serve as an example of recording medium, and an image-forming unit 4 for forming images on the sheets P supplied by the sheet-feeding unit 3.

Directions will be specified based on the state of the printer 1 resting on a level surface. Thus, the right side of FIG. 1 will be considered the front side of the printer 1, and the left side will be considered the rear side of the printer 1. Further, left and right sides of the printer 1 will be defined based on the perspective of a user looking at the printer 1 from the front. Thus, the near side of FIG. 1 is the left side, and the far side is the right side.

(1) Main Casing

Formed in the main casing 2 are a cartridge access opening 5 (an example of a second opening) for mounting and removing a process cartridge 15 (described later), and a paper-introducing opening 6 (an example of a first opening) through which the sheets P of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a front-rear direction.

The main casing 2 also includes a top cover 7 disposed on the upper end portion thereof, and a sheet-feeding cover 8 disposed on the front end portion thereof. The top cover 7 serves as an example of an opening/closing member.

The top cover 7 is formed into a substantially flat plate shape extending in the front-rear direction. The top cover 7 has pressing parts 10 on a lower surface thereof at its substantially center region in the front-rear direction.

More specifically, a plurality of (two) the pressing parts 10 are provided on the top cover 7 in correspondence with a plurality of (two) pressed parts 78 (to be described later with reference to FIG. 3), which are provided on a drum holding part 75 (to be described later) at left and right end portions thereof. The pressing parts 10 are disposed on the top cover 7 such that the pressing parts 10 confront with each other with a space formed therebetween in the left-right direction. Each pressing part 10 is formed into a substantially rectangular shape in a side view extending downward from the lower surface of the top cover 7 and is formed so as to extend in the left-right direction.

As indicated by the two-dotted chain lines in FIG. 1, the top cover 7 is disposed so as to be capable of pivoting (moving) about its rear edge portion between a closed position for covering the cartridge access opening 5, and an open position (see FIG. 9) for exposing the cartridge access opening 5.

The sheet-feeding cover 8 is formed into a substantially flat plate shape extending vertically. The sheet-feeding cover 8 is disposed so as to be capable of pivoting (moving) about its bottom edge portion between a first position for covering the paper-introducing opening 6, and a second position (see FIG. 2) for exposing the paper-introducing opening 6 (see the two-dotted chain lines in FIG. 1).

(2) Sheet-Feeding Unit

The sheet-feeding unit 3 includes a sheet-supporting part 9 provided in the bottom portion of the main casing 2.

Figure 2:
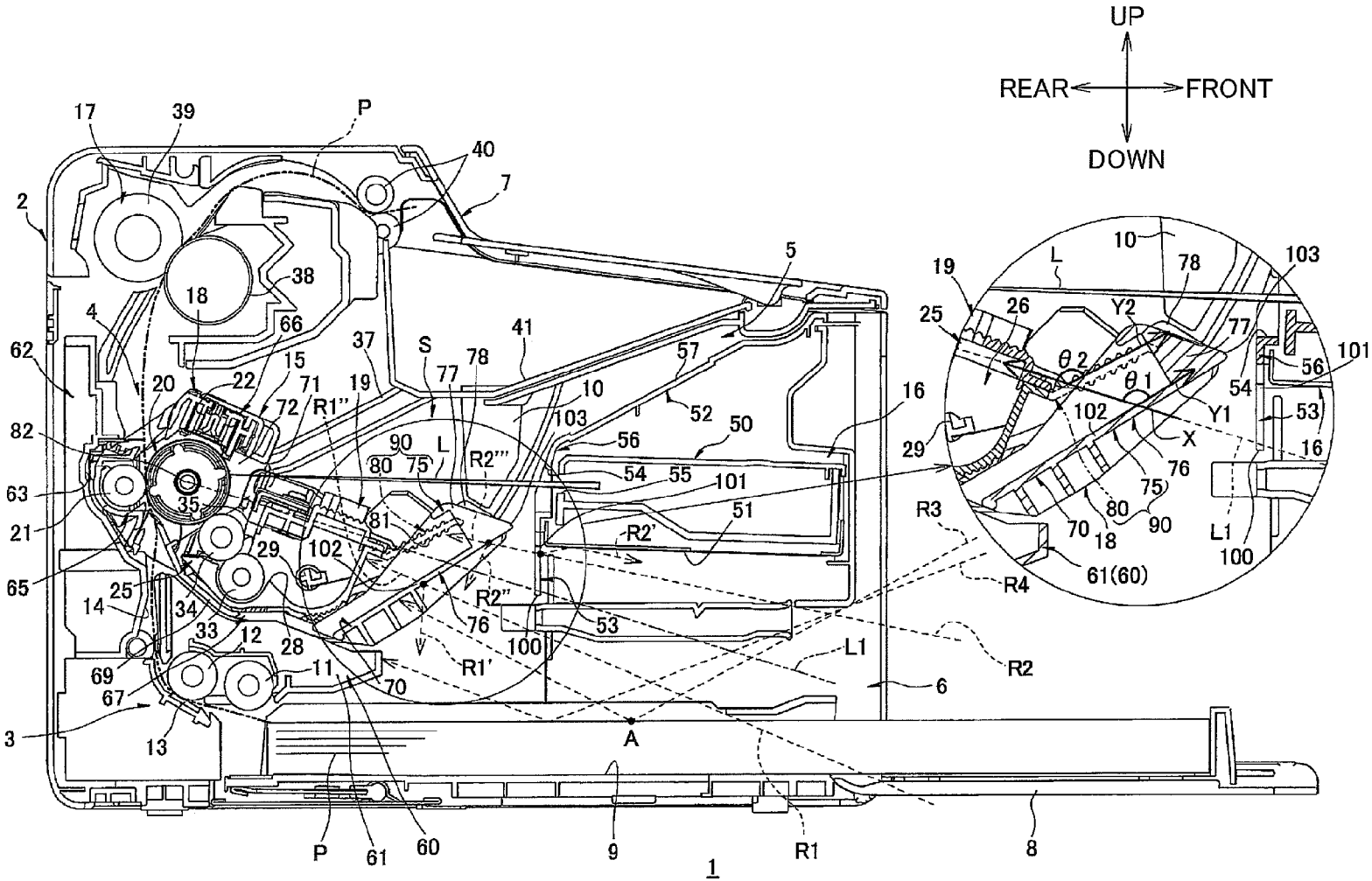
FIG. 2 is a cross-sectional side view of the printer shown in FIG. 1, in which the sheet-feeding cover is in a second position.

As shown in FIG. 2, the sheet-supporting part 9 is in communication with the exterior of the main casing 2 through the paper-introducing opening 6.

The sheets P of paper are placed in the sheet-feeding unit 3 when the sheet-feeding cover 8 is in its second position such that rear portions of the sheets P are stacked in the sheet-supporting part 9 and front portions of the sheets P are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

As shown in FIG. 1, the image-forming unit 4 includes the process cartridge 15, a scanning unit 16 serving as an exposing member, and a fixing unit 17.

(3-1) Process Cartridge

The process cartridge 15 can be mounted in and removed from the inside of the main casing 2. When mounted in the main casing 2, the process cartridge 15 is arranged above a rear portion of the sheet-feeding unit 3.

The process cartridge 15 includes a drum cartridge 18 and a developing cartridge 19. The drum cartridge 18 is an example of a photosensitive body cartridge. The developing cartridge 19 is an example of a developer accommodating cartridge.

The drum cartridge 18 includes a photosensitive drum 20 as an example of a photosensitive body, a transfer roller 21, and a scorotron charger 22.

The photosensitive drum 20 is formed in a general cylindrical shape that is elongated in a left-right direction. The photosensitive drum 20 is rotatably provided in a rear portion of the drum cartridge 18.

The transfer roller 21 is formed in a cylindrical shape that is elongated in the left-right direction. The transfer roller 21 is provided in pressure contact with the rear side of the photosensitive drum 20.

More specifically, the transfer roller 21 is disposed on the rear side of the photosensitive drum 20 such that the axial center of the transfer roller 21 is positioned slightly lower than the axial center of the photosensitive drum 20. Note that the transfer roller 21 has a lower peripheral surface higher than a lower peripheral surface of the photosensitive drum 20. That is, a virtual line segment (not shown) connecting the axial center of the transfer roller 21 to the axial center of the photosensitive drum 20 forms an acute angle of approximately 3 degrees with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 is arranged to confront the upper front side of the photosensitive drum 20 with a gap formed therebetween.

More specifically, the scorotron charger 22 is disposed in a position separated from the transfer roller 21 in a circumferential direction of the photosensitive drum 20. The scorotron charger 22 is disposed such that the virtual line segment (not shown) connecting the axial center of the photosensitive drum 20 with the axial center of the transfer roller 21 forms an angle of approximately 120 degrees with a virtual line segment (not shown) connecting the axial center of the photosensitive drum 20 with a charging wire 23 (described later).

The scorotron charger 22 includes the charging wire 23 and a grid 24.

The charging wire 23 is arranged in a taut state to extend in the left-right direction and is disposed so as to confront but remain separated from the upper front side of the photosensitive drum 20.

The grid 24 is formed to have a general U-shape in a side view with the opening of the "U" facing diagonally upward and forward so as to surround the charging wire 23 from a lower rear side thereof.

The developing cartridge 19 is disposed on the lower front side of the photosensitive drum 20. The developing cartridge 19 includes a developing-cartridge frame 25.

A toner-accommodating chamber 26 and a development chamber 27 are formed in the developing-cartridge frame 25. The toner-accommodating chamber 26 and development chamber 27 are provided side by side in the front-rear direction, with a communication opening 28 allowing communication between the two. The toner-accommodating chamber 26 and development chamber 27 have substantially the same capacity as each other.

The toner-accommodating chamber 26 accommodates toner (an example of developer). An agitator 29 is provided in an approximate front-rear and vertical center region of the toner-accommodating chamber 26. In other words, the agitator 29 is located at a vertical position lower than the photosensitive drum 20.

In the development chamber 27 are formed a supply-roller groove 30, a developing-roller-opposing surface 31, and a lower-film-adhering surface 32 on a top surface of a bottom wall of the development chamber 27.

The supply-roller groove 30 is formed on the top surface of the bottom wall so as to be recessed obliquely downward and rearward. The supply-roller groove 30 is formed in a general semicircular shape conforming to a circumferential surface of a supply roller 33 (described later).

The developing-roller-opposing surface 31 is formed in a general arc shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. That is, the lower-film-adhering surface 32 is arranged higher than the developing-roller-opposing surface 31.

The lower-film-adhering surface 32 is also arranged to confront the bottom portion of the photosensitive drum 20 vertically, with a gap formed therebetween. The lower-film-adhering surface 32 is arranged to overlap the axial center of the photosensitive drum 20 when projected or seen vertically.

The supply roller 33, the developing roller 34, a thickness-regulating blade 35, and a lower film 36 are provided in the development chamber 27.

The supply roller 33 is rotatably provided in a front region of the development chamber 27 with its bottom portion disposed in the supply-roller groove 30. With this configuration, the supply roller 33 is disposed to the rear side of the toner-accommodating chamber 26 and is arranged at the same approximate height as the toner-accommodating chamber 26 (slightly higher than the toner-accommodating chamber 26).

The developing roller 34 is rotatably provided in a rear region of the development chamber 27 such that its bottom circumferential surface opposes the developing-roller-opposing surface 31 yet remains separated therefrom.

The developing roller 34 is also disposed to contact the upper rear side of the supply roller 33 and so that its upper and rear portions are exposed outside the development chamber 27 and contact the lower front side of the photosensitive drum 20. In other words, the developing roller 34 is arranged on the upper rear side of the supply roller 33 and the lower front side of the photosensitive drum 20. The axial centers of the supply roller 33, developing roller 34, and photosensitive drum 20 are positioned on substantially the same line following a radial direction of the photosensitive drum 20.

The developing roller 34 is also disposed in a position separated from the scorotron charger 22 in the circumferential direction of the photosensitive drum 20 and is arranged such that a virtual line segment (not shown) connecting the axial center of the photosensitive drum 20 to the charging wire 23 forms an angle of approximately 120 degrees with a virtual line segment (not shown) connecting the axial center of the photosensitive drum 20 to the axial center of the developing roller 34. Hence, the developing roller 34, scorotron charger 22, and transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from the front side thereof.

The lower film 36 has a rear portion fixed to the lower-film-adhering surface 32. A front edge of the lower film 36 contacts the circumferential surface of the developing roller 34 above the developing-roller-opposing surface 31.

(3-2) Scanning Unit

The scanning unit 16 is arranged in the front region in the main casing 2 at a front side of the process cartridge 15 and confronting the process cartridge 15.

The scanning unit 16 irradiates a laser beam L (an example of a laser light) toward the photosensitive drum 20 based on image data, thereby exposing the circumferential surface of the photosensitive drum 20.

More specifically, the scanning unit 16 irradiates the laser beam L rearward such that the laser beam L passes through the gap between the plurality of (two) pressing parts 10, to thereby expose the circumferential surface of the photosensitive drum 20 on the front side thereof. In other words, the exposure point at which the photosensitive drum 20 is exposed to light (the circumferential surface on the front side of the photosensitive drum 20) is configured to be on a side opposite to a nip part at which the photosensitive drum 20 and transfer roller 21 contact each other with respect to the axial center of the photosensitive drum 20.

At this time, the developing cartridge 19 is arranged beneath an irradiation path of the laser beam L, while the scorotron charger 22 is disposed above the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22.

(4) Image-Forming Operation

As shown in FIG. 2, the agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively turbocharged between the supply roller 33 and developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20, forming an electrostatic latent image on the circumferential surface of the photosensitive drum 20 based on image data. Next, the toner carried on the developing roller 34 is supplied to the latent image on the circumferential surface of the photosensitive drum 20 so that a toner image (developer image) is carried on the circumferential surface of the photosensitive drum 20.

The rotating pickup roller 11 supplies the sheets P stacked on the sheet-supporting part 9 between the feeding roller 12 and feeding pad 13, and the rotating feeding roller 12 separates the sheets P, conveys each separated sheet P onto the feeding path 14, and supplies the sheets P one at a time to the image-forming unit 4 (between the photosensitive drum 20 (to be described later) and transfer roller 21 (to be described later)) at a prescribed timing.

The sheet P is conveyed upward between the photosensitive drum 20 and transfer roller 21, at which time the toner image is transferred from the photosensitive drum 20 onto the sheet P, forming an image on the sheet P.

Next, the sheet P passes between the heating roller 38 and pressure roller 39. At this time, the heating roller 38 and pressure roller 39 apply heat and pressure to the sheet P to thermally fix the image to the sheet P.

The sheet P is subsequently conveyed toward discharge rollers 40. The discharge rollers 40 discharge the sheet P onto a discharge tray 41 formed on a top surface of the main casing 2.

In this way, the sheet P is supplied from the sheet-supporting part 9 and conveyed along a conveying path that has a general C-shape in a side view, passing first between the photosensitive drum 20 and transfer roller 21 (nip part) and next between the heating roller 38 and pressure roller 39, and subsequently being discharged onto the discharge tray 41.

2. Details of Main Casing

(1) Process Cartridge Mounting Part

As illustrated in FIG. 1, a process cartridge mounting part 60 is provided in the main casing 2.

The process cartridge mounting part 60 is configured to support the process cartridge 15 disposed at a mounting position (to be described later). The process cartridge mounting part 60 is disposed between a rear portion of the sheet-feeding unit 3 and the fixing unit 17 in the vertical direction.

The process cartridge mounting part 60 is formed into a substantially L-shape in a side view and extends in the left-right direction. The process cartridge mounting part 60 includes a first mounting part 61 and a second mounting part 62.

The first mounting part 61 is formed into a substantially rectangular shape in a side view extending in the front-rear direction. The first mounting part 61 rotatably supports the pickup roller 11 and feeding roller 12 at its lower end portion. The top surface of the first mounting part 61 is formed conforming to a lower end portion of the process cartridge 15 (specifically, a bottom wall 69 (to be described later) of a cartridge mounting part 67 (to be described later)).

The second mounting part 62 is formed into a substantially rectangular shape in a side view extending in the vertical direction. An engagement groove 63 is formed on the front surface of the second mounting part 62 at its substantially center region in the vertical direction.

The engagement groove 63 is formed on the front surface of the second mounting part 62 so as to be recessed rearward. The engagement groove 63 is formed in a substantially curved shape in a side view conforming to the rear end portion of the process cartridge 15 (specifically, a rear end portion of a drum accommodating part 66 (to be described later)).

The second mounting part 62 is disposed rearward of the first mounting part 61 such that part of the front surface of the second mounting part 62 below the engagement groove 63 confronts the rear surface of the first mounting part 61 with a space formed therebetween in the front-rear direction. The rear surface of the first mounting part 61 and the part of the front surface of the second mounting part 62 below the engagement groove 63 constitute the above-described feeding path 14.

(2) Scanning Unit

The scanning unit 16 is disposed rearward and upward of the paper-introducing opening 6. The scanning unit 16 is disposed forward of the second mounting part 62 such that the scanning unit 16 confronts the second mounting part 62 with a space formed therebetween. A mounting/removing space S is defined between the scanning unit 16 and second mounting part 62 for mounting the process cartridge 15 in the main casing 2 and removing the process cartridge 15 from the main casing 2. Mounting/removing guide parts 37 are provided on inner surfaces of left and right side walls of the main casing 2 in the left-right direction at their regions corresponding to the mounting/removing space S. Although details of the mounting/removing guide parts 37 will be described later, the mounting/removing guide parts 37 guide movement of the process cartridge 15 to be mounted in or removed from the main casing 2.

The scanning unit 16 includes a scanner support part 51, a scanner main body 50, and a scanner cover 52.

The scanner support part 51 is formed into a substantially U-shape in a side view, with the opening of the "U" shape facing upward, and extends in the left-right direction. The scanner support part 51 is fixed to the main casing 2 with its left and right edges supported by the left and right side walls of the main casing 2, respectively, and with its front edge supported by part of the main casing 2 at a periphery of an upper edge of the paper-introducing opening 6.

The scanner main body 50 is formed into a box shape having a substantially rectangular shape in a side view. A laser emitting part (not illustrated) and a polygon mirror (not illustrated) are accommodated in the internal space of the scanner main body 50. An exposure opening 55 is formed at a rear end portion of the scanner main body 50 so as to allow a laser beam L emitted from the laser emitting part (not illustrated) to pass therethrough. The scanner main body 50 is supported on a top surface of the scanner support part 51.

The scanner cover 52 is formed of, e.g., polystyrene resin. The scanner cover 52 is formed into a substantially V shape in a side view, with the opening of the "V" shape facing obliquely forward and downward. The scanner cover 52 integrally includes: a first cover part 56 extending in the vertical direction; and a second cover part 57 extending obliquely in a direction connecting a rear-lower side to a front-upper side.

Figure 6:
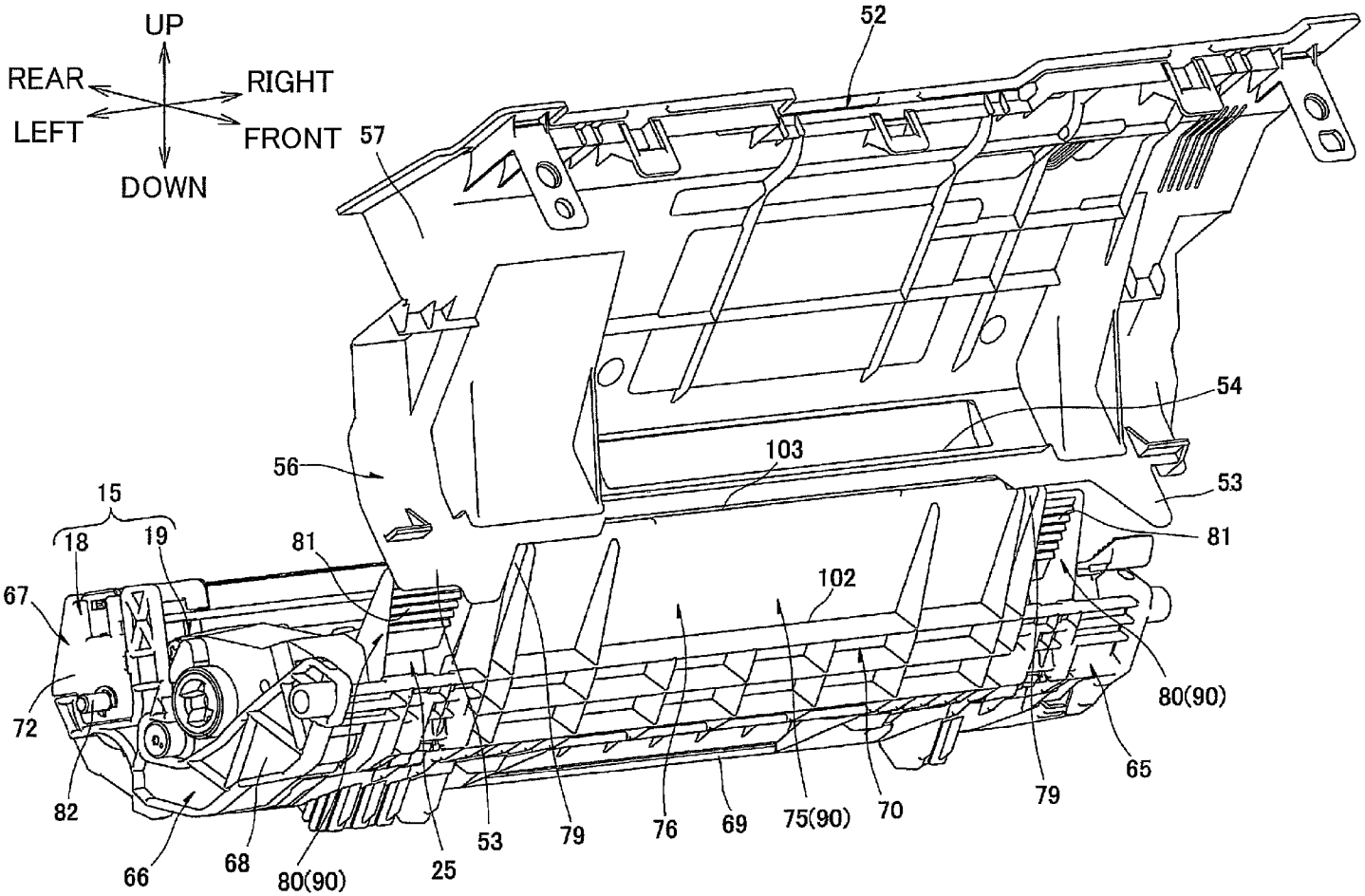
FIG. 6 is a perspective view of the process cartridge and light shielding parts shown in FIG. 2 as viewed from their lower-front side.

As illustrated in FIG. 6, the first cover part 56 is formed into a substantially flat plate shape extending in the vertical and left-right directions. A laser passage opening 54 is formed at a substantially center region of the first cover part 56. The laser passage opening 54 penetrates the first cover part 56 in the front-rear direction. The laser passage opening 54 is formed into a rectangular shape in a front view elongated in the left-right direction in correspondence with the exposure opening 55 shown in FIG. 1.

The first cover part 56 is integrally formed with light shielding parts 53 serving as an example of a light shielding member.

More specifically, a plurality of (two) light shielding parts 53 protrude downward from a lower end portion of the first cover part 56 at its left and right end portions. Thus, the light shielding parts 53 are arranged in the left-right direction with a space formed therebetween. The light shielding parts 53 are each formed into a substantially rectangular shape in a front view. As shown in FIG. 2, each light shielding part 53 has an upper end 101 (base end) and a lower end 100 (distal end) opposite to each other. The light shielding part 53 is connected at the upper end 101 to the first cover part 56. The light shielding part 53 extends from the upper end 101 downwardly to the lower end 100.

As shown in FIG. 6, the inner edge of each light shielding part 53 in the left-right direction is inclined obliquely outward in the left-right direction toward the lower side.

As illustrated in FIG. 1, the second cover part 57 is formed into a substantially flat plate shape extending continuously from an upper edge of the first cover part 56 toward forward and upward in a mounting/removing direction Z (to be described later) of the process cartridge 15, in which the process cartridge 15 is mounted in or removed from the main casing 2.

The scanner cover 52 is disposed such that the first cover part 56 covers the scanner main body 50 from the rear side and the second cover part 57 covers the scanner main body 50 from the upper side. The scanner cover 52 is supported by the main casing 2 such that the upper edge of the second cover part 57 is fixed to the upper end portion in the front end portion of the main casing 2.

3. Details of Process Cartridge

Figure 3:
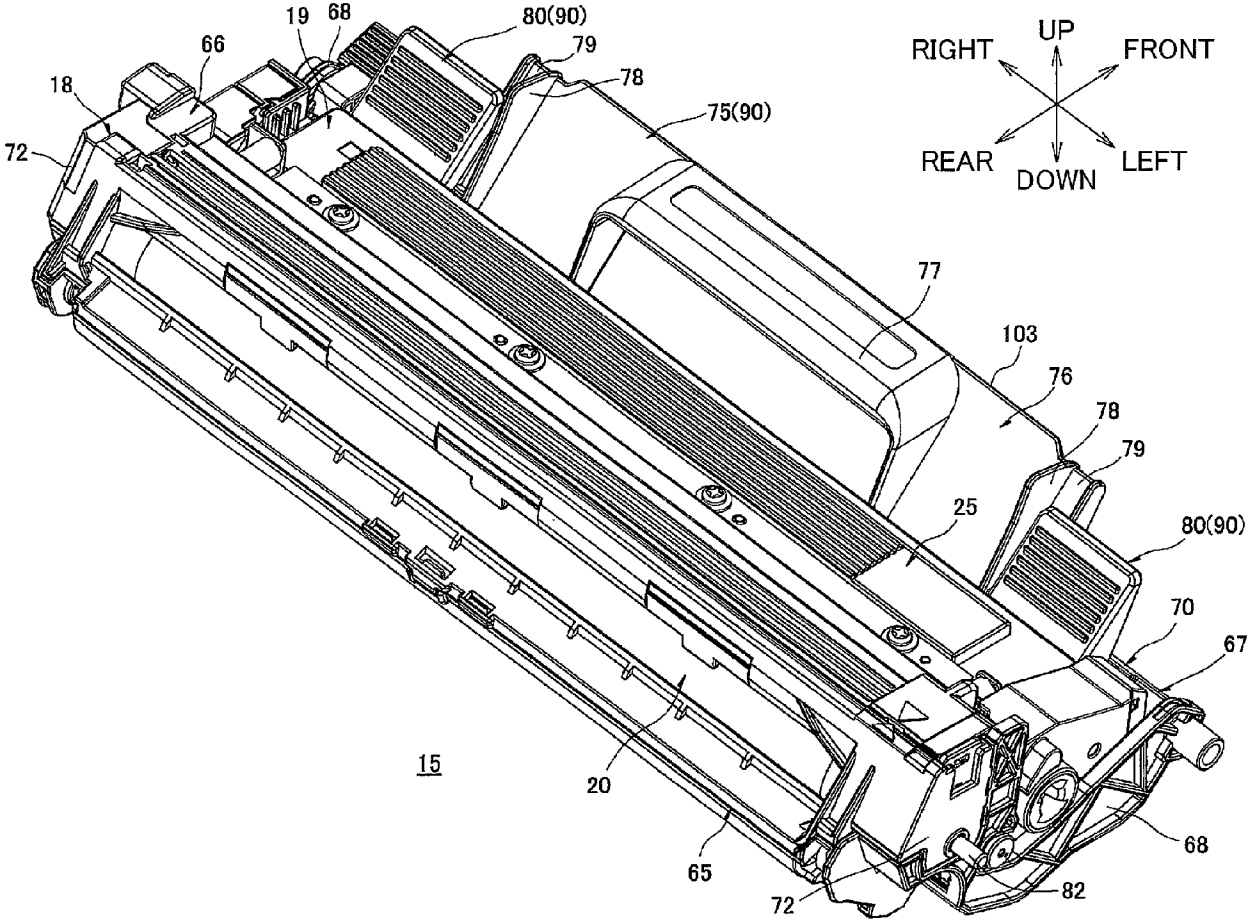
FIG. 3 is a perspective view of a process cartridge shown in FIG. 2 as viewed from its upper-left side.

As shown in FIG. 3, the process cartridge 15 includes the drum cartridge 18 and the developing cartridge 19. The drum cartridge 18 is removably mountable in the main casing 2 as shown in FIG. 1. The developing cartridge 19 is detachably attached to the drum cartridge 18.

(1) Drum Cartridge

Figure 5:
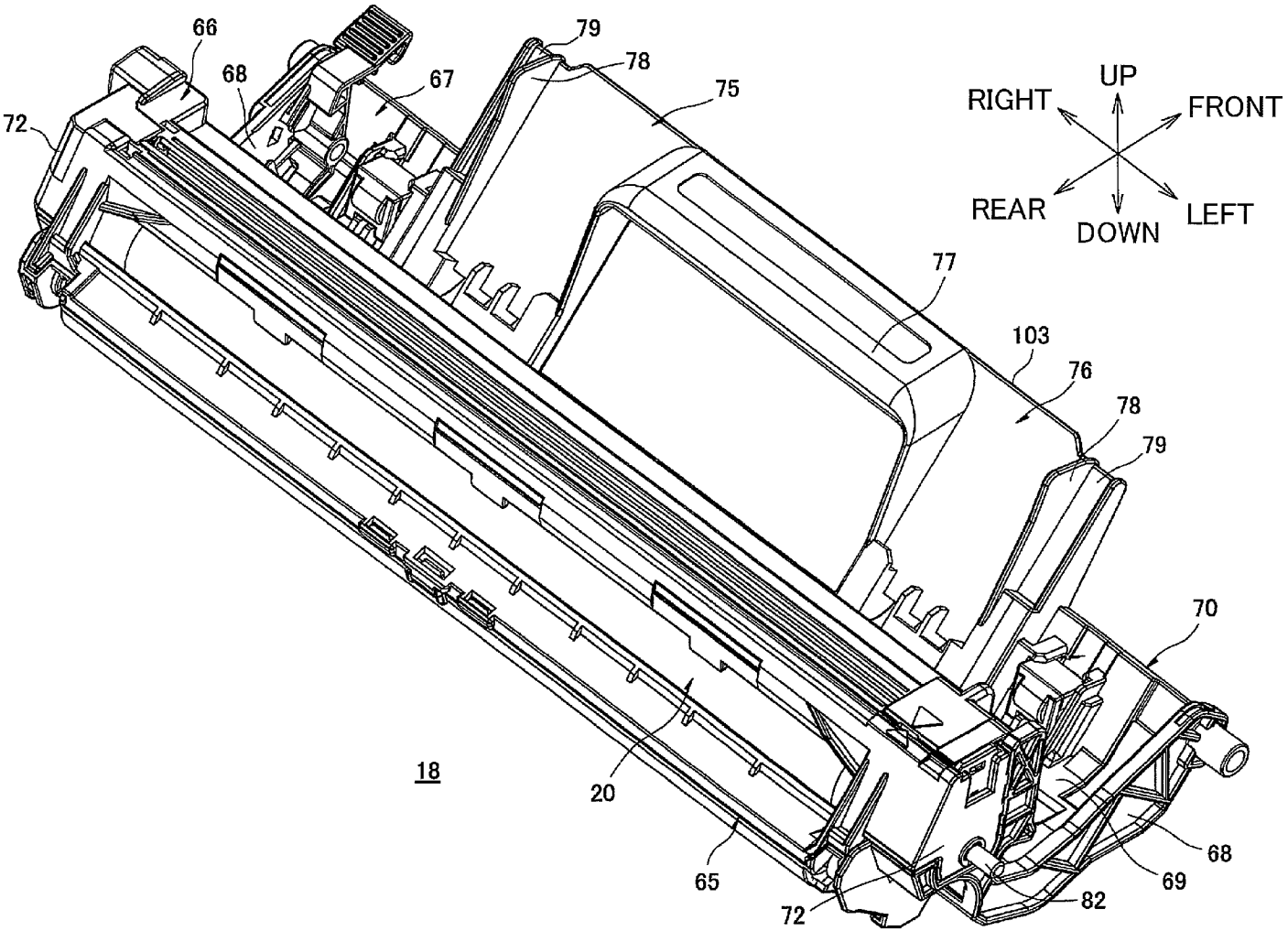
FIG. 5 is a perspective view of a drum cartridge shown in FIG. 2 as viewed from its upper-left side.

As shown in FIG. 5, the drum cartridge 18 has a drum frame 65.

A rear portion of the drum frame 65 is formed as the drum accommodating part 66, and a front portion of the drum frame 65 is formed as a cartridge mounting part 67.

(1-1) Drum Accommodating Part

The drum accommodating part 66 is formed into a substantially box shape extending in the left-right direction and having its front side opened. A front end portion of the drum accommodating part 66 defines a drum opening 71 as shown in FIG. 1. The drum accommodating part 66 includes a pair of drum-accommodating-part side walls 72 which are disposed opposite to each other with a space formed therebetween in the left-right direction.

Each drum-accommodating-part side wall 72 is formed into a substantially flat plate shape having a substantially rectangular shape in a side view and extending in the vertical and front-rear directions.

As illustrated in FIG. 1, the photosensitive drum 20 and transfer roller 21 are accommodated in the drum accommodating part 66.

The photosensitive drum 20 has a drum shaft 82 extending in the left-right direction as shown in FIG. 5. The photosensitive drum 20 is rotatably supported in the drum accommodating part 66, with left and right ends of the drum shaft 82 being supported by the pair of drum-accommodating-part side walls 72. Note that the left and right ends of the drum shaft 82 penetrate the drum-accommodating-part side walls 72 and protrude outward in the left-right direction.

(1-2) Cartridge Mounting Part

The cartridge mounting part 67 is formed into a substantially box shape with its upper side opened to allow the developing cartridge 19, shown in FIG. 3, to be attached to and detached from the cartridge mounting part 67. The cartridge mounting part 67 includes: a pair of cartridge-mounting-part side walls 68 disposed opposite to each other with a space formed therebetween in the left-right direction; a bottom wall 69 connecting the lower edges of the cartridge-mounting-part side walls 68; and a front wall 70 connecting the front edges of the cartridge-mounting-part side walls 68.

Each cartridge-mounting-part side wall 68 is formed into a substantially flat plate shape extending continuously forward from the lower end portion on the front edge of the corresponding drum-accommodating-part side wall 72.

The bottom wall 69 is formed into a substantially flat plate shape extending in the front-rear and left-right directions.

The front wall 70 is formed continuously from the front edge of the bottom wall 69 so as to be inclined obliquely upward toward the front side as shown in FIG. 1.

The drum accommodating part 66 and cartridge mounting part 67 communicate with each other in the front-rear direction through the drum opening 71, as illustrated in FIG. 1.

Further, as illustrated in FIG. 5, the cartridge mounting part 67 is integrally provided with a drum holding part 75 serving as an example of a photosensitive-body cartridge holding part.

The drum holding part 75 is provided at the front wall 70. The drum holding part 75 integrally includes a main body 76, a grip part 77, the pressed parts 78, and extension parts 79.

The main body 76 is formed into a substantially flat plate shape extending continuously from the upper edge of the front wall 70 at a substantially left-right center region of the front wall 70 such that the main body 76 extends toward forward and upward from the upper edge of the front wall 70 as shown in FIG. 1 and extends also in the left-right direction.

More in detail, as illustrated in FIG. 2, the main body 76 has a lower end 102 (base end) and an upper end 103 (distal end) opposite to each other. The main body 76 is connected at the lower end 102 to the front wall 70. The main body 76 extends from the lower end 102 to the upper end 103 so as to be inclined upward toward the front side. The main body 76 intersects a first direction X, wherein the first direction X is directed from the vertical center portion of the paper-introducing opening 6 toward the axial center of the drum shaft 82 of the photosensitive drum 20.

An obtuse angle $\theta 1$ is formed between the first direction X and a second direction Y1 in which the main body 76 extends from its lower end 102 to its upper end 103. The amount of the obtuse angle $\theta 1$ is not less than 90 degrees and less than 180 degrees, specifically, 130 degrees.

As illustrated in FIG. 5, the grip part 77 is formed in a substantially rectangular parallelepiped tube shape protruding rearward from the rear surface of the main body 76 at a substantially center region thereof in the left-right direction.

The pressed parts 78 are provided on the rear surface of the main body 76 at left and right end portions thereof. The pressed parts 78 are each formed into a substantially triangular flat plate shape in a side view protruding rearward from the rear surface of the main body 76.

The extension parts 79 are each formed into a substantially flat plate shape protruding continuously from the left and right end portions of the main body 76 toward outward in the left-right direction.

(2) Developing Cartridge

As illustrated in FIG. 3, the developing cartridge 19 includes the developing cartridge frame 25.

The developing-cartridge frame 25 is formed into a substantially box shape extending in the left-right direction as shown in FIG. 1. The developing-cartridge frame 25 has developing-cartridge holding parts 80 at its front edge. The developing-cartridge holding parts 80 serve as an example of a developer-accommodating cartridge holding part.

The developing-cartridge holding parts 80 are provided to the front edge of the developing-cartridge frame 25 at left and right end portions thereof. Each developing-cartridge holding part 80 is formed into a substantially flat plate shape extending continuously from the front edge of the developing-cartridge frame 25 toward forward and upward as shown in FIG. 2, and extending also in the left-right direction.

More in detail, as illustrated in FIG. 2, the developing-cartridge holding part 80 has a lower end (base end) and an upper end (distal end) opposite to each other. The developing-cartridge holding part 80 is connected at its lower end to the developing-cartridge frame 25. The developing-cartridge holding part 80 extends from its lower end to its upper end so as to be inclined upward toward the front side. The developing-cartridge holding part 80 intersects the first direction X.

An obtuse angle θ2 is formed between the first direction X and a third direction Y2 in which the developing-cartridge holding part 80 extends from its lower end to its upper end. The amount of the obtuse angle θ2 is not less than 90 degrees and less than 180 degrees, specifically, 115 degrees.

Figure 4:
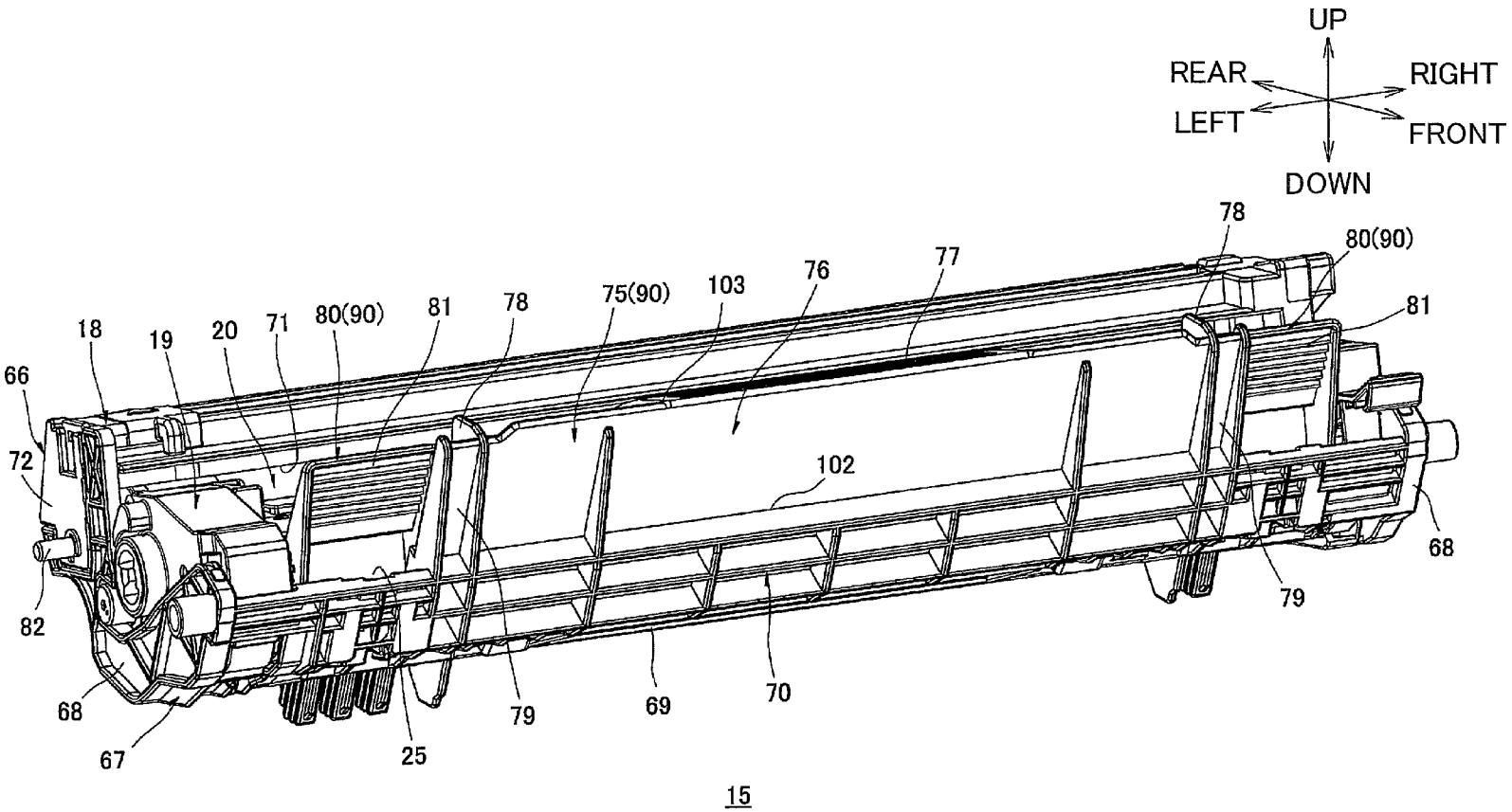
FIG. 4 is a perspective view of the process cartridge shown in FIG. 3 as viewed from its lower-front side.

A plurality of ridges 81 (an example of a corrugated region) are formed on a front surface of each developing-cartridge holding part 80 as illustrated in FIG. 4.

The ridges 81 protrude forward from the front surface of the developing-cartridge holding part 80. The ridges 81 are elongated in the left-right direction. The ridges 81 are arranged at intervals in an up-down direction, in which the developing-cartridge holding part 80 extends from its lower end to its upper end.

The developing cartridge 19 is attached to the cartridge mounting part 67 of the drum cartridge 18, as illustrated in FIG. 3.

In a state where the developing cartridge 19 is attached to the cartridge mounting part 67, the plurality of (two) developing-cartridge holding parts 80 are disposed confronting their corresponding pressed portions 78 from outer sides in the left-right direction. In other words, the developing-cartridge holding parts 80 are disposed at outer sides of the left and right ends of the drum holding part 75 in the left-right direction such that the developing-cartridge holding parts 80 confront the left and right ends of the drum holding part 75 in the left-right direction. In this way, the drum holding part 75 and plurality of (two) developing-cartridge holding parts 80 are arranged side by side in the left-right direction.

Further, as illustrated in FIG. 4, the plurality of (two) extension parts 79 are disposed such that if the extension parts 79 are viewed in the front-rear direction, the extension parts 79 overlap inner portions of the developing-cartridge holding parts 80 in the left-right direction.

With this configuration, as illustrated in FIG. 3, the drum holding part 75 and plurality of (two) developing-cartridge holding parts 80 constitute a process cartridge holding part 90 serving as an example of a process cartridge holding part. The process cartridge holding part 90 is provided at a front end portion of the process cartridge 15 (one end portion of the process cartridge 15 at the paper-introducing opening 6 side).

The developing cartridge 19 is detached from the cartridge mounting part 67 by a user holding the developing-cartridge holding parts 80 and pulling the same upwardly.

(3) Mounting State of Process Cartridge in Main Casing

As illustrated in FIG. 1, the process cartridge 15 having the above-described configuration is disposed at the mounting position at which the process cartridge 15 is supported by the process cartridge mounting part 60.

Specifically, in a state where the process cartridge 15 is disposed at the mounting position, the rear end portion of the drum accommodating part 66 is fitted into the engagement groove 63 of the second mounting part 62, and the bottom wall 69 of the cartridge mounting part 67 is disposed on the first mounting part 61. The left and right ends of the drum shaft 82 are fitted into the rear end portions of the mounting/removing guide parts 37.

The photosensitive drum 20 is disposed rearward of the scanner main body 50 and confronts the scanner main body 50 with a space formed therebetween. The process cartridge holding part 90 (drum holding part 75 and plurality of (two) developing-cartridge holding parts 80) is disposed between the photosensitive drum 20 and paper-introducing opening 6. That is, the process cartridge holding part 90 is disposed at the same side as the scanning unit 16 with respect to the photosensitive drum 20. In other words, similarly to the scanning unit 16, the process cartridge holding part 90 is disposed frontward of the photosensitive drum 20.

The process cartridge holding part 90 is disposed rearward and downward of the scanner main body 50. The process cartridge holding part 90 is disposed below the irradiation path of the laser beam L with a space being formed therebetween.

Thus, the laser beam L travels above the process cartridge holding part 90 and through the mounting/removing space S from its front side to its rear side, and is irradiated on a region of the peripheral surface of the photosensitive drum 20 that is exposed through the drum opening 71. That is, the upper edge and the rear surface of the process cartridge holding part 90 are disposed such that the laser beam L travels past the upper edge and the rear surface of the process cartridge holding part 90. In this way, a space for allowing the laser beam L to be irradiated on the photosensitive drum 20 (exposing space) is ensured inside the mounting/removing space S.

As illustrated in FIG. 2, a virtual line segment L1 is defined as a line segment connecting the vertical center portion of the paper-introducing opening 6 and the axial center of the drum shaft 82 of the photosensitive drum 20. The virtual line segment L1 serves as an example of a line segment connecting the axial center of the photosensitive drum 20 and the paper-introducing opening 6. The first direction X is defined as being directed along the virtual line segment L1 from the vertical center portion of the paper-introducing opening 6 to the axial center of the drum shaft 82 of the photosensitive drum 20. The process cartridge holding part 90 is disposed such that in a side view, the process cartridge holding part 90 intersects the virtual line segment L1 and the process cartridge holding part 90 overlaps a plane of projection that is obtained by projecting the paper-introducing opening 6 in the first direction X toward the photosensitive drum 20.

Further, as illustrated in FIG. 6, the plurality of (two) developing-cartridge holding parts 80 are disposed rearward of the light shielding parts 53 such that each developing-cartridge holding part 80 confronts the corresponding light shielding part 53 with a space formed therebetween. In other words, as illustrated in FIG. 2, the plurality of (two) light shielding parts 53 are disposed between the process cartridge 15 and paper-introducing opening 6 such that each light shielding part 53 overlaps the corresponding developing-cartridge holding part 80 if the light shielding part 53 is projected or seen in a direction toward rearward (more in detail, in a direction toward the photosensitive drum 20).

The upper ends 101 of the light shielding parts 53 and the upper end of the process cartridge holding part 90 (specifically, the upper end 103 of the main body 76 of the drum holding part 75) are both disposed above (to one side of) the virtual line segment L1, and the lower ends 100 of the light shielding parts 53 and the lower end of the process cartridge holding part 90 (specifically, the lower end 102 of the main body 76 of the drum holding part 75) are both disposed below (to the other side of) the virtual line segment L1.

4. Mounting/Removing Operation of Process Cartridge in/from Main Casing

The following describes how to mount the process cartridge 15 in the main casing 2 and how to remove the process cartridge 15 from the main casing 2.

(1) Removing Operation of Process Cartridge from Main Casing

To remove the process cartridge 15 from the main casing 2, first the top cover 7 of the main casing 2 is disposed at its open position (see FIG. 9), as described above and as shown in FIG. 1.

Subsequently, the process cartridge holding part 90 of the process cartridge 15, specifically, the grip part 77 of the drum holding part 75 is held by a user to pull the front end portion of the process cartridge 15 toward forward and upward.

As a result, the process cartridge 15 is turned or rotated in the counterclockwise direction in a left side view about the drum shaft 82 of the photosensitive drum 20.

The drum holding part 75 is further pulled toward upward and forward. The process cartridge 15 moves through the mounting/removing space S in the mounting/removing direction Z and is removed from the main casing 2 through the cartridge access opening 5.

At this time, the developing cartridge 19 attached to the drum cartridge 18 crosses the irradiation path of the laser beam L from below to above. Various rollers (transfer roller 21, supply roller 33, and developing roller 34) also cross the irradiation path of the laser beam L from below to above.

With the above-described procedure, removing of the process cartridge 15 from the main casing 2 is completed.

(2) Mounting Operation of Process Cartridge in Main Casing 2

To mount the process cartridge 15 in the main casing 2, a procedure reverse to the above-described removing operation is performed.

Specifically, in a state where the top cover 7 is disposed at the open position (see FIG. 9), the process cartridge 15 is inserted by a user into the mounting/removing space S through the cartridge access opening 5 so that the left and right ends of the drum shaft 82 are fitted into the mounting/removing guide parts 37.

Subsequently, as the process cartridge 15 is pushed toward downward and rearward along the mounting/removing guide parts 37, the process cartridge 15 is moved toward rearward and downward in the mounting/removing direction Z.

When the left and right ends of the drum shaft 82 reach the rear end portions of the respective mounting/removing guide parts 37, the process cartridge 15 is turned or rotated in the clockwise direction in a left side view about the drum shaft 82.

As a result, the rear end portion of the drum accommodating part 66 is fitted into the engagement groove 63, and the bottom wall 69 of the cartridge mounting part 67 is disposed on the first mounting part 61.

Thus, the process cartridge 15 is disposed at the mounting position.

Subsequently, the top cover 7 is moved from the open position to the closed position.

Figure 7:
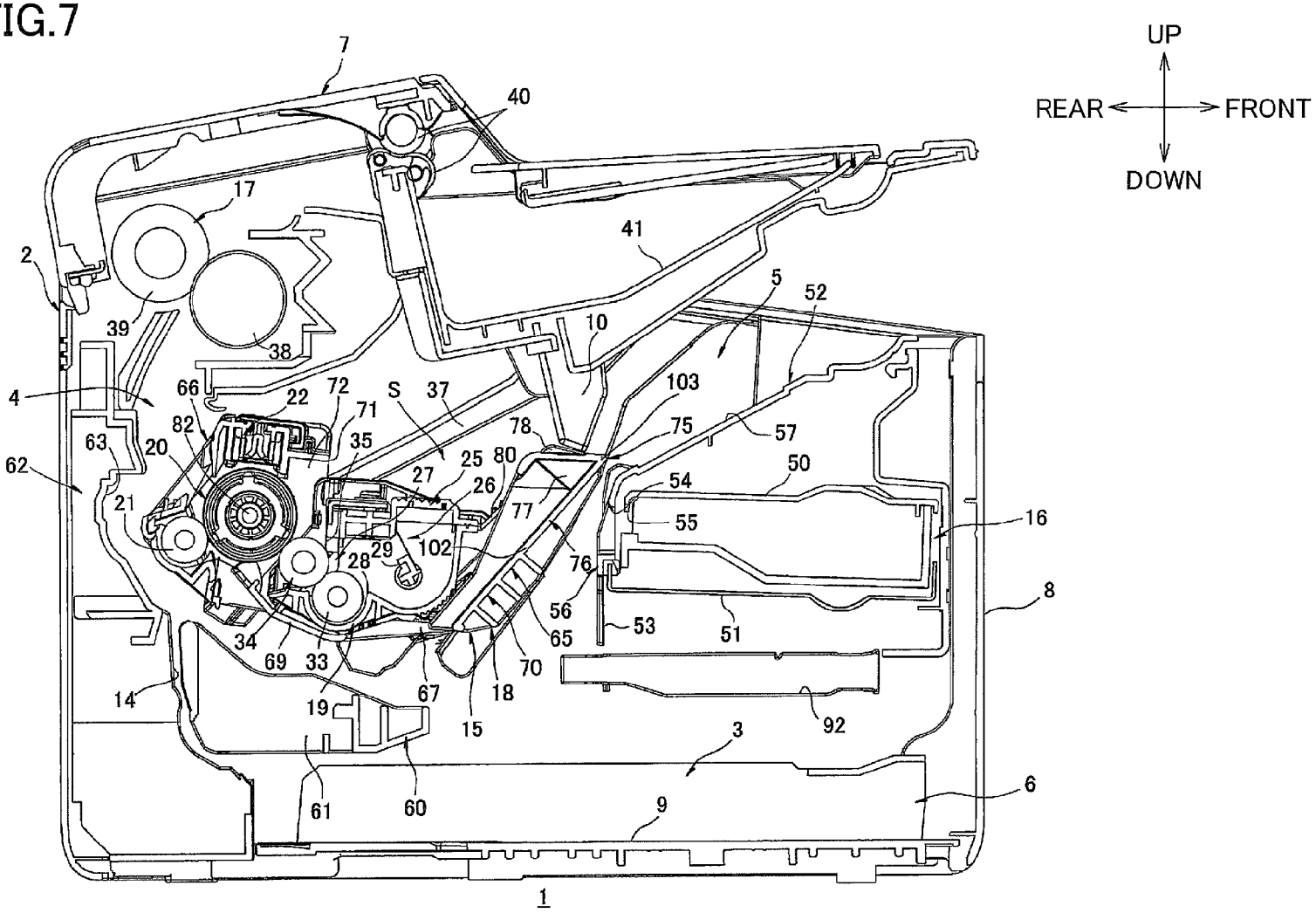
FIG. 7 illustrates how pressing parts on a top cover shown in FIG. 1 press the process cartridge.

When the top cover 7 is moved from the open position to closed position, if the process cartridge 15 is still being in the middle of the mounting process, that is, if the process cartridge 15 has not yet reached the mounting position, the pressing parts 10 abut against the upper end portions of the pressed parts 78 from above, as illustrated in FIG. 7.

As the top cover 7 further moves, the process cartridge 15 is pressed downward at the pressed parts 78 by the pressing parts 10.

As a result, the process cartridge 15 is moved from the position on the way to the mounting position to the mounting position.

With the above-described procedure, the mounting of the process cartridge 15 in the main casing 2 is completed.

5. Blocking of Light that has Entered from Paper-Introducing Opening

In the printer 1, as illustrated in FIG. 2, the sheet-feeding cover 8 is disposed at the second position opening the paper-introducing opening 6 during the image forming operation. Thus, light may enter the inside of the main casing 2 from the paper-introducing opening 6.

Examples of light that enters the main casing 2 from the paper-introducing opening 6 include: a light beam R1 that passes through a lower end portion of the paper-introducing opening 6 and travels in a direction toward the axial center of the drum shaft 82 of the photosensitive drum 20; a light beam R2 that passes through an upper end portion of the paper-introducing opening 6 and travels in a direction toward the axial center of the drum shaft 82; and a light beam R3 that passes through the upper end portion of the paper-introducing opening 6, reflects off the surface of the sheet P, and then travels in a direction toward the axial center of the drum shaft 82.

The light beam R1 contains: a light beam R1' that reaches the main body 76 of the drum holding part 75; and a light beam R1" that travels in the space at an outer side of the main body 76 of the drum holding part 75 in the left-right direction (see FIG. 4) and reaches the front surface of the developing-cartridge frame 25.

The light beam R1' hits the front surface of the main body 76 of the drum holding part 75 and is reflected by the main body 76 in a direction toward downward.

The light beam R1" is blocked by the front surface of the developing-cartridge frame 25.

The light beam R2 contains: a light beam R2' that reaches one of the light shielding parts 53; a light beam R2" that travels through the gap between the plurality of (two) light shielding parts 53 (see FIG. 6) and reaches the main body 76 of the drum holding part 75; and a light beams R2'" that travels in the space at an outer side of the main body 76 of the drum holding part 75 in the left-right direction and reaches one of the developing-cartridge holding parts 80.

The light beam R2' hits the front surface of the light shielding part 53 and is reflected by the light shielding part 53 in a direction toward forward and upward. The light beam R2' then reflects off a lower surface of the scanner support part 51, which is disposed forward and upward of the light shielding parts 53, and travels back to the paper-introducing opening 6.

The light beam R2" hits the front surface of the main body 76 of the drum holding part 75 and is then reflected by the main body 76 in a direction toward rearward and downward.

The light beam R2"' hits the front surface of the developing-cartridge holding part 80 and is diffusely reflected by the plurality of ridges 81.

In this manner, the process cartridge holding part 90 (drum holding part 75 and developing-cartridge holding parts 80) and the light shielding parts 53 are each configured to prevent at least part of light that has entered the main casing 2 through the paper-introducing opening 6 from reaching the photosensitive drum 20.

The light beam R3 reflects off the surface of the sheet P at an incident point A, and travels in a direction toward the axial center of the drum shaft 82.

The light beam R3 then reaches the front surface of the front wall 70 of the drum cartridge 18, and is blocked by the front wall 70.

It is noted that a light beam R4 passes through the upper end portion of the paper-introducing opening 6 and reflects off the surface of the sheet P at a position rearward of the incident point A, reaches the first mounting part 61, and is blocked by the first mounting part 61.

6. Functions (1) In the printer 1, as illustrated in FIG. 2, the process cartridge holding part 90 is configured to prevent at least part of light that has entered the main casing 2 through the paper-introducing opening 6 from reaching the photosensitive drum 20. In other words, the process cartridge holding part 90 is configured to suppress exposure of the photosensitive drum 20 to light that has entered the main casing 2 from the paper-introducing opening 6. It is therefore possible to suppress degradation of the surface of the photosensitive drum 20. Further, it is possible to suppress occurrence of changes in the electric potential at the surface of the photosensitive drum 20 during the image forming operation.

Because the process cartridge holding part 90 is configured to block light, it is possible to suppress degradation of the surface of the photosensitive drum 20 and occurrence of defective image formation, without providing any additional light shielding member in the inside of the main casing 2.

The process cartridge 15 is removably mounted inside the main casing 2. The mounting/removing space S (removing space) for mounting/removing of the process cartridge 15 is ensured in the main casing 2. The process cartridge holding part 90 is accommodated in the mounting/removing space S so as to be held by a user in order to remove the process cartridge 15 from the main casing 2.

In other words, the space used both for holding the process cartridge holding part 90 and for blocking light is ensured in the mounting/removing space S.

Thus, the space used for blocking light need not be additionally ensured inside the main casing 2, thereby achieving downsizing of the main casing 2, which in turn can lead to downsizing of the printer 1.

Thus, according to the printer 1 of the present invention, degradation of the photosensitive drum 20 can be suppressed, occurrence of defective image formation can be suppressed, and downsizing of the printer 1 can be achieved.

(2) Further, as illustrated in FIG. 2, in a state where the process cartridge 15 is mounted inside the main casing 2, the process cartridge holding part 90 is disposed overlapping the plane of projection that is obtained by projecting the paper-introducing opening 6 in a direction toward the photosensitive drum 20.

Thus, the process cartridge holding part 90 can reliably block at least part of light that travels from the paper-introducing opening 6 in a direction toward the photosensitive drum 20 (e.g., light beam R1 and light beam R2).

As a result, it is possible to suppress exposure of the photosensitive drum 20 to light that enters the main casing 2 from the paper-introducing opening 6, particularly to light that travels from the paper-introducing opening 6 in a direction toward the photosensitive drum 20 (e.g., light beam R1 and light beam R2).

(3) Further, the process cartridge 15 is configured to be removably mounted inside the main casing 2. As illustrated in FIG. 3, the process cartridge 15 includes: the drum cartridge 18 provided with the photosensitive drum 20 (FIG. 1); and the developing cartridge 19 configured to be detachably attached to the drum cartridge 18 and configured to accommodate toner therein.

With this configuration, if, for example, lifetime of the photosensitive drum 20 is reached, it is only necessary to replace the drum cartridge 18 with a new one; and if a residual amount of toner becomes smaller than a predetermined amount, it is only necessary to replace the developing cartridge 19 with a new one.

Accordingly, the running cost can be reduced as compared to a configuration in which toner is accommodated and the photosensitive drum 20 is provided in a single cartridge.

In order to replace the drum cartridge 18 with a new one, a user can remove the drum cartridge 18 from the main casing 2 by holding the drum holding part 75. Thus, removing work of the drum cartridge 18 from the main casing 2 can be smoothly performed.

In order to replace the developing cartridge 19 with a new one, a user can detach the developing cartridge 19 from the drum cartridge 18 by holding the developing-cartridge holding parts 80. Thus, detachment work of the developing cartridge 19 from the drum cartridge 18 can also be smoothly performed.

Thus, the running cost can be reduced, and detachment work of the drum cartridge 18 and developing cartridge 19 can be smoothly performed.

(4) As illustrated in FIG. 3, in a state where the developing cartridge 19 is attached to the drum cartridge 18, the drum holding part 75 and developing-cartridge holding parts 80 are disposed side by side in the left-right direction (longitudinal direction of the photosensitive drum 20).

Thus, the amount of the gap between the drum holding part 75 and developing-cartridge holding parts 80 can be reduced.

As a result, as illustrated in FIG. 2, light that has entered the main casing 2 through the paper-introducing opening 6 can be suppressed from passing through the gap between the drum holding part 75 and developing-cartridge holding parts 80.

Thus, even though the process cartridge 15 has the drum cartridge 18 and developing cartridge 19, at least part of light that has entered the main casing 2 from the paper-introducing opening 6 is blocked by the drum holding part 75 and developing-cartridge holding parts 80, and therefore is prevented from reaching the photosensitive drum 20.

(5) Further, as illustrated in FIG. 3, in a state where the developing cartridge 19 is attached to the drum cartridge 18, the developing-cartridge holding parts 80 are each disposed confronting a corresponding pressed portion 78 of the drum holding part 75 from an outer side in the left-right direction (outer side in the longitudinal direction).

With this configuration, the drum holding part 75 is disposed at a substantially center region of the process cartridge holding part 90 in the left-right direction so as to be sandwiched between the developing-cartridge holding parts 80. Thus, a user can easily hold the drum holding part 75 when removing the process cartridge 15 from the main casing 2. Removing work of the process cartridge 15 from the main casing 2 can be smoothly performed.

(6) As illustrated in FIG. 4, the drum holding part 75 is provided with the extension parts 79 that protrude outwardly from the drum holding part 75 in the left-right direction.

In a state where the developing cartridge 19 is attached to the drum cartridge 18, the extension parts 79 are disposed such that if the extension parts 79 are projected or seen in the front-rear direction (in a direction perpendicular to the longitudinal direction of the photosensitive drum 20), the extension parts 79 overlap the inner portions of the developing-cartridge holding parts 80 in the left-right direction.

Thus, when viewed from the front, the extension parts 79 are disposed between the main body 76 of the drum holding part 75 and the developing-cartridge holding parts 80.

The extension parts 79 can therefore reliably block light that travels in directions toward the gaps between the main body 76 of the drum holding part 75 and developing-cartridge holding parts 80 (e.g., light beam R2) as illustrated in FIG. 2.

In this manner, at least part of light that has entered the main casing 2 from the paper-introducing opening 6 (e.g., light beam R2) can be reliably blocked by the main body 76 of the drum holding part 75, developing-cartridge holding parts 80, and extension parts 79 of the drum holding part 75.

(7) As illustrated in FIG. 1, the main casing 2 is formed with the cartridge access opening 5 for mounting and removing the process cartridge 15, and is provided with the top cover 7.

Thus, the process cartridge 15 can be reliably mounted in and removed from the main casing 2 through the cartridge access opening 5.

As illustrated in FIG. 7, the top cover 7 has the pressing parts 10. When the process cartridge 15 is in the middle of the mounting operation to the main casing 2 (when the process cartridge 15 is not yet disposed at the mounting position), the pressing parts 10 abut against the drum holding part 75 when the top cover 7 is moved from the open position to the closed position. The process cartridge 15 is pressed by the pressing parts 10 at the drum holding part 75, and is moved from a position, which is on the way to the mounting position, to the mounting position.

Thus, by moving the top cover 7 from the open position to closed position, the process cartridge 15 can be reliably mounted in the main casing 2.

(8) As illustrated in FIG. 2, the main casing 2 includes the light shielding parts 53 which are disposed between the paper-introducing opening 6 and the process cartridge 15 mounted in the main casing 2.

With this configuration, at least part of light that has entered the main casing 2 from the paper-introducing opening 6 (e.g., light beam R2) is reliably blocked by the light shielding parts 53 and process cartridge holding part 90.

It is possible to reliably suppress exposure of the photosensitive drum 20 to light that has entered the main casing 2 from the paper-introducing opening 6 (e.g., light beam R2).

(9) As illustrated in FIG. 6, in a state where the process cartridge 15 is mounted inside the main casing 2, the light shielding parts 53 are disposed such that if the light shielding parts 53 are projected or seen in a direction toward rearward (more in detail, in a direction toward the photosensitive drum 20), the light shielding parts 53 overlap the developing-cartridge holding parts 80.

Thus, as illustrated in FIG. 2, at least part of light that travels from the paper-introducing opening 6 in a direction toward the photosensitive drum 20 (e.g., light beam R2) is reliably blocked by the light shielding parts 53 and developing-cartridge holding parts 80.

It is possible to reliably suppress exposure of the photosensitive drum 20 to light that travels from the paper-introducing opening 6 in a direction toward the photosensitive drum 20 (e.g., light beam R2).

(10) As illustrated in FIG. 6, the light shielding parts 53 are arranged in the left-right direction (longitudinal direction of the photosensitive drum 20) with a space formed therebetween.

Thus, jam processing (processing of removing a jammed sheet through the paper-introducing opening 6) can be easily performed through the space between the light shielding parts 53.

In particular, the light shielding parts 53 are disposed such that the light shielding parts 53 overlap the developing-cartridge holding parts 80 if the light shielding parts 53 are projected or seen in a direction toward rearward. Accordingly, the jam processing can be easily performed, as well as, light that travels from the paper-introducing opening 6 in a direction toward the photosensitive drum 20 (e.g., light beam R2) can be reliably suppressed from reaching the photosensitive drum 20.

(11) As illustrated in FIG. 2, in a side view, the upper ends 101 (base ends) of the light shielding parts 53 and the upper end (distal end) of the process cartridge holding part 90 (specifically, the upper end 103 of the main body 76 of the drum holding part 75) are both disposed above (to one side of) the virtual line segment L1 that connects the vertical center portion of the paper-introducing opening 6 and the axial center of the drum shaft 82 of the photosensitive drum 20. The lower ends 100 (distal ends) of the light shielding parts 53 and the lower end (base end) of the process cartridge holding part 90 (specifically, the lower end 102 of the main body 76 of the drum holding part 75) are both disposed below (to the other side of) the virtual line segment L1.

In other words, the upper ends 101 of the light shielding parts 53, at which the light shielding parts 53 are connected to the first cover part 56, are disposed above the virtual line segment L1, and the lower end of the process cartridge holding part 90, i.e., the lower end 102 of the main body 76, at which the main body 76 is connected to the front wall 70, is disposed below the virtual line segment L1.

With this configuration, at least part of light that enters the main casing 2 from the paper-introducing opening 6 and travels in a direction toward the photosensitive drum 20 (e.g., light beam R1 and light beam R2) is reliably blocked by at least one of the light shielding parts 53 and process cartridge holding part 90.

Light that has entered the main casing 2 from the paper-introducing opening 6 can be more reliably suppressed from reaching the photosensitive drum 20.

(12) As illustrated in FIG. 2, the process cartridge holding part 90 is provided at the front end portion (end portion on the paper-introducing opening 6 side) of the process cartridge 15. That is, the process cartridge holding part 90 is provided at the front end portion of the process cartridge 15 that is disposed closer to the paper-introducing opening 6 among the front and rear end portions of the process cartridge 15.

Thus, in a state where the process cartridge 15 is mounted in the main casing 2, the process cartridge holding part 90 can be disposed near the paper-introducing opening 6.

As a result, as compared to a case where the process cartridge holding part 90 is provided at a portion of the process cartridge 15 different from the front end portion thereof, the process cartridge holding part 90 can block a relatively larger amount of light that has entered the main casing 2 from the paper-introducing opening 6.

It is possible to reliably suppress exposure of the photosensitive drum 20 to light that has entered the main casing 2 from the paper-introducing opening 6.

(13) As illustrated in FIG. 4, the plurality of ridges 81 are formed on the front surface (surface on the paper-introducing opening 6 side) of each of the developing-cartridge holding parts 80. That is, the plurality of ridges 81 are formed on the surface of each developing-cartridge holding part 80 that faces the paper-introducing opening 6.

With this configuration, as illustrated in FIG. 2, light that enters the main casing 2 from the paper-introducing opening 6 and reaches the front surface of the developing-cartridge holding part 80 (e.g., light beam R2''') is diffusedly reflected by the plurality of ridges 81.

As a result, light that has entered the main casing 2 from the paper-introducing opening 6 can be suppressed from travelling in a direction toward the photosensitive drum 20. It is therefore possible to reliably suppress exposure of the photosensitive drum 20 to light that has entered the main casing 2 from the paper-introducing opening 6 (e.g., light beam R2).

(14) As illustrated in FIG. 2, the drum holding part 75 of the process cartridge holding part 90 (specifically, main body 76) is connected at its lower end (specifically, the lower end 102 of the main body 76) to the process cartridge 15. The drum holding part 75 (specifically, main body 76) extends from its lower end to its upper end (distal end), while intersecting the first direction X directed from the paper-introducing opening 6 toward the photosensitive drum 20.

The obtuse angle θ1 is formed between the first direction X and the second direction Y1 in which the drum holding part 75 (specifically, the main body 76) extends from its lower end to its upper end.

With this configuration, light that enters the main casing 2 from the paper-introducing opening 6 and hits the front surface of the main body 76 of the drum holding part 75 (e.g., light beam R1' and light beam R2") is reflected by the main body 76 in a direction toward downward (to the base end side of the process cartridge holding part 90) with respect to a point (light incident point) on the front surface of the main body 76 where the light reaches.

As a result, light that has entered the main casing 2 from the paper-introducing opening 6 (e.g., light beam R1 and light beam R2) can be suppressed from entering the mounting/removing space S that is provided above the upper end (distal end) of the process cartridge holding part 90. Thus, light that has entered the main casing 2 from the paper-introducing opening 6 can be suppressed from traveling in the mounting/removing space S and reaching the photosensitive drum 20.

(15) As illustrated in FIG. 2, the printer 1 includes the scanning unit 16 disposed inside the main casing 2. In a state where the process cartridge 15 is mounted in the main casing 2, the process cartridge holding part 90 is disposed at the same side as the scanning unit 16 with respect to the photosensitive drum 20.

Thus, the amount of a gap formed between the process cartridge holding part 90 and scanning unit 16 can be reduced.

With this configuration, light that has entered the main casing 2 from the paper-introducing opening 6 can be suppressed from traveling through the gap between the process cartridge holding part 90 and scanning unit 16 to enter the mounting/removing space S (exposure space).

Thus, the light that has entered the main casing 2 from the paper-introducing opening 6 can be suppressed from traveling through the mounting/removing space S and reaching the photosensitive drum 20.

(16) As illustrated in FIG. 2, in a state where the process cartridge 15 is mounted in the main casing 2, the front surface (surface on the paper-introducing opening 6 side) of the process cartridge holding part 90 (drum holding part 75 and developing-cartridge holding parts 80) blocks at least part of the light that has entered the main casing 2 from the paper-introducing opening 6. That is, a surface of the process cartridge holding part 90 that faces the paper-introducing opening 6 blocks at least part of the light that has entered the main casing 2 from the paper-introducing opening 6.

With this configuration, light that has entered the main casing 2 from the paper-introducing opening 6 can be reliably suppressed from entering the mounting/removing space S (exposure space).

Further, the process cartridge holding part 90 allows the laser beam L to travel past the upper edge and the rear surface of the process cartridge holding part 90 (surface opposite to the surface of the process cartridge holding part 90 that faces the paper-introducing opening 6 side). That is, the laser beam L passes by the rear surface of the process cartridge holding part 90, which is opposite to the front surface of the process cartridge holding part 90 that faces the paper-introducing opening 6. Thus, the photosensitive drum 20 can be reliably exposed to the laser beam L.

6. Second Embodiment

Next, a second embodiment of the present invention will be described below.

Figure 8:
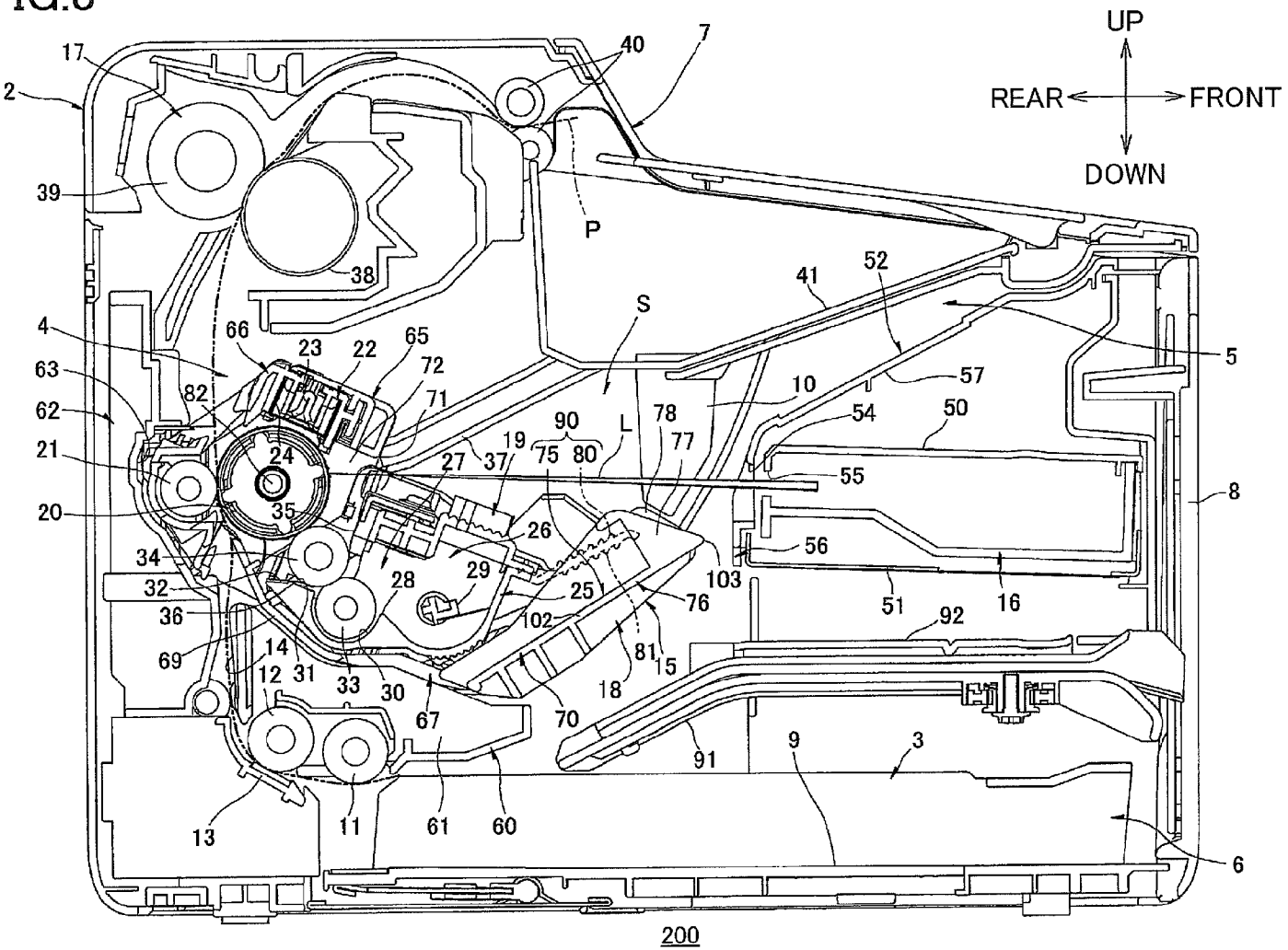
FIG. 8 is a cross-sectional side view of a printer according to a second embodiment of the present invention.

FIG. 8 is a cross-sectional side view illustrating a printer 200 according to the second embodiment.

The same reference numerals as those shown in the FIGS. 1 to 7 are given to the corresponding parts in FIG. 8, and description thereof is omitted.

In the second embodiment, as illustrated in FIG. 8, the main casing 2 is provided with support parts 92, and a manual feed tray 91 is supported by the support parts 92. The manual feed tray 91 serves as an example of a guide part. The support parts 92 are for supporting the manual feed tray 91 and serves as an example of a support part.

As also illustrated in FIG. 1, the support parts 92 are provided on the inner surfaces of the left and right side walls of the main casing 2 in the left-right direction. The support parts 92 are disposed below the scanning unit 16 and rearward of the upper end portion of the paper-introducing opening 6. Each support part 92 is formed into a substantially U-shape in a side view, with the opening of the "U" shape facing forward. The support parts 92 are formed on the inner surfaces of the left and right side walls of the main casing 2 in the left-right direction so as to protrude therefrom toward inward in the left-right direction.

The manual feed tray 91 is formed into a substantially flat plate shape extending in the front-rear and left-right directions and is formed so as to be extendable and retractable in the front-rear direction. The left and right ends of the manual feed tray 91 are supported by the support parts 92, whereby the manual feed tray 91 is fixed to the main casing 2.

During the image forming process, when necessary, the manual feed tray 91 having the above-described configuration is extended forward so as to protrude outwardly from the main casing 2 through the paper-introducing opening 6.

A sheet P is introduced into the main casing 2 through the paper-introducing opening 6, while being guided on the upper surface of the manual feed tray 91. The sheet P is then supplied to the pickup roller 11.

The manual feed tray 91 can smoothly introduce the sheet P into the main casing 2 through the paper-introducing opening 6. Thus, introducing of the sheet P to the main casing 2 can be performed smoothly.

Also in the second embodiment, the same operational advantages as those obtained in the first embodiment can be obtained.

In addition, the manual feed tray 91 and support parts 92 block at least part of light that has entered the main casing 2 from the paper-introducing opening 6. It is possible to more reliably prevent at least part of light that has entered the main casing 2 through the paper-introducing opening 6 from reaching the photosensitive drum 20.

7. Third Embodiment

A third embodiment of the present invention will be described below.

Figure 9:
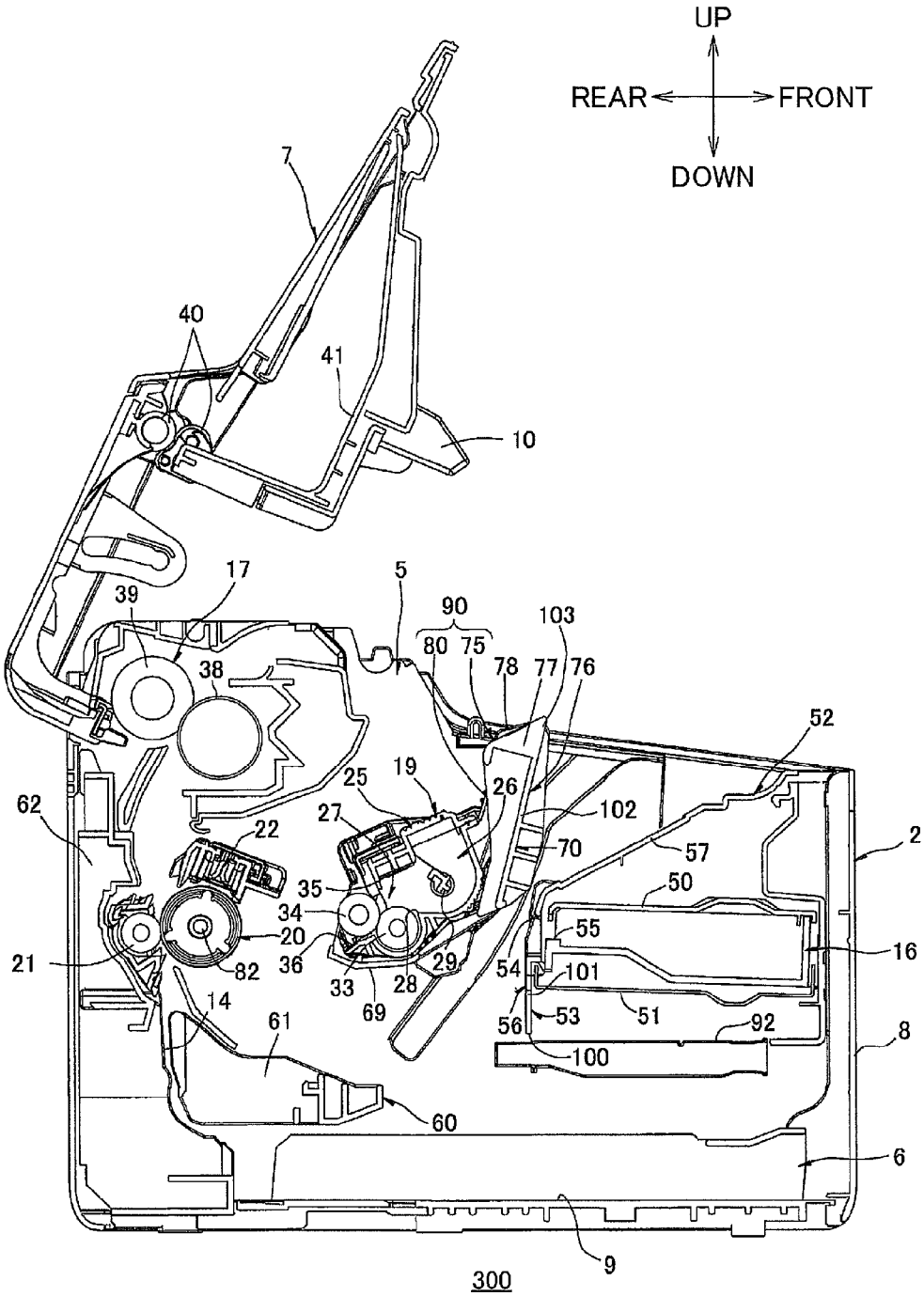
FIG. 9 is a cross-sectional side view of a printer according to a third embodiment of the present invention, in which a developing cartridge is in the middle of being mounted in or removed from a main casing of the printer.

FIG. 9 is a cross-sectional side view illustrating a printer 300 according to the third embodiment. FIG. 9 illustrates a state where the developing cartridge is in the middle of the mounting or removing operation.

The same reference numerals as those shown in the FIGS. 1 to 7 are given to the corresponding parts in FIG. 9, and description thereof is omitted.

In the above-described first and second embodiments, as illustrated in FIG. 1, the photosensitive drum 20, transfer roller 21, and scorotron charger 22 are provided in the drum cartridge 18.

Contrarily, in the third embodiment, as illustrated in FIG. 9, the photosensitive drum 20, transfer roller 21, and scorotron charger 22 are provided in the main casing 2.

In the third embodiment, the developing-cartridge frame 25 of the developing cartridge 19 is integrally provided with the drum holding part 75 and developing-cartridge holding parts 80. The integrally-provided drum holding part 75 and developing-cartridge holding parts 80 are constituted as an example of a developer-accommodating cartridge holding part.

Thus, the same operational advantages as those obtained in the first embodiment can be obtained.

Specifically, the drum holding part 75 and developing-cartridge holding parts 80 can prevent at least part of light that has entered the main casing 2 through the paper-introducing opening 6 from reaching the photosensitive drum 20. Thus, the drum holding part 75 and developing-cartridge holding parts 80 can suppress exposure of the photosensitive drum 20 to light that has entered the main casing 2 through the paper-introducing opening 6, thereby suppressing degradation of the surface of the photosensitive drum 20 and occurrence of defective image formation.

Further, the space for blocking light need not be additionally provided inside the main casing 2, thereby achieving downsizing of the main casing 2, which in turn can lead to downsizing of the printer 300.

8. Modifications

In the first to third embodiments, as illustrated in FIG. 1, the light shielding parts 53 are formed to extend downward from the lower edge of the first cover part 56.

Instead, as indicated by a virtual line in FIG. 1, each light shielding part 53 may be formed to protrude from the lower edge of the first cover part 56 such that the light shielding part 53 is inclined rearward toward the lower side. That is, the lower end 100 (distal end) of the light shielding part 53 is disposed rearward of (at the process cartridge 15 side relative to) the upper end 101 (base end) of the light shielding part 53. In other words, in a state where the process cartridge 15 is mounted inside the main casing 2, each light shielding part 53 is disposed between the paper-introducing opening 6 and process cartridge 15 with the lower end 100 (distal end) of the light shielding part 53 being disposed at the process cartridge 15 side relative to the upper end 101 (base end) of the light shielding part 53.

With this configuration, the amount of a gap between the lower end 100 (distal end) of the light shielding part 53 and the lower end (base end) of the process cartridge holding part 90 (drum holding part 75 and developing-cartridge holding parts 80) can be reduced.

Thus, light that has entered the main casing 2 can be suppressed from traveling through between the light shielding part 53 and the process cartridge holding part 90, and can be reliably blocked by the light shielding part 53 and/or the process cartridge holding part 90.

Further, by disposing the lower end 100 of the light shielding part 53 rearward of (at the process cartridge 15 side relative to) the upper end 101 of the light shielding part 53, it is possible to increase the size of part of the light shielding part 53 (overlapping part) that overlaps the corresponding developing-cartridge holding part 80 (FIG. 6) if the light shielding part 53 is projected or seen in the first direction X shown in FIG. 2.

Thus, light that travels from the paper-introducing opening 6 in a direction toward the photosensitive drum 20 (e.g., light beam R2 shown in FIG. 2) can be blocked more reliably by the light shielding parts 53 and process cartridge holding part 90.

It is possible to more reliably suppress exposure of the photosensitive drum 20 to light that has entered the main casing 2 from the paper-introducing opening 6.

The above-described printers 1, 200, and 300 are merely examples of the image forming apparatus of the present invention, and the present invention is not limited to the above-described first to third embodiments.

For example, the image forming apparatus of the present invention may be constituted not only to the above-described monochromic printer but also to a color printer.

Examples of the color printer include: a direct tandem color printer provided with a plurality of photosensitive bodies and a recording medium conveying member; and an intermediate-transfer-type tandem color printer provided with a plurality of photosensitive bodies, an intermediate transfer body, and a transfer member.

In addition to the separable process cartridge 15 that allows the drum cartridge 18 and developing cartridge 19 to be detached from each other as described above, the process cartridge 15 may be an integrated unit in which the drum cartridge 18 and developing cartridge 19 are integrally provided.

The developing cartridge 19 may also be configured such that a toner cartridge for accommodating toner is detachably mountable on a frame provided with the developing roller 34.

Each of the printers 1, 200, and 300 is provided with the sheet-feeding cover 8. Instead, each of the printers 1, 200, and 300 may be provided with a sheet feed cassette (sheet feed tray).

In place of the photosensitive drum 20, a photosensitive belt or other photosensitive body may be employed.

In place of the developing roller 34, a developing sleeve, developing belt, brush roller, or other developer bearing member may be used.

Further, in place of the supply roller 33, a supply sleeve, a supply belt, a brush roller, or other supply member may be used.

Further, in place of the agitator 29, an auger screw, a conveying belt, or other conveying member may be used.

Further, in place of the transfer roller 21, a contact-type transfer member, such as a transfer belt, a transfer brush, a transfer blade, and a film-like transfer device; or a non-contact-type transfer member such as a corotron-type transfer member may be used.

Further, in place of the scorotron charger 22, a non-contact type charger, such as a corotron-type charger and a charger provided with a sawtooth discharge member; or a contact-type charger such as a charging roller may be used.

Further, in place of the scanning unit 16, an exposing member such as an LED unit may be used.

Further, the image forming apparatus of the present invention may be configured as a multifunction device provided with an image scanner.

With the constructions according to these variations and modifications, the same operational advantages as those described above in the first embodiment can be achieved.

Incidentally, the depicted configurations according to the first through third embodiments, variations and modifications can also be combined appropriately depending on intended purposes and usage.

While the invention has been described in detail with reference to the embodiments, variations and modifications thereof, it would be apparent to those skilled in the art that various changes and modifications may be made therein without departing from the spirit of the invention.

What is claimed is:

1. An image forming apparatus comprising:

a housing formed with a first opening through which a recording medium is to be introduced into an inside of the housing; and a process cartridge configured to be mounted in the inside of the housing and provided with a photosensitive body, the process cartridge being provided with a process-cartridge holding part configured to be held by a user so as to remove the process cartridge from the housing, the process-cartridge holding part being configured such that in a state where the process cartridge is mounted in the inside of the housing, the process-cartridge holding part prevents at least part of light that has entered the inside of the housing through the first opening from reaching the photosensitive body, wherein the process cartridge includes:

a photosensitive body cartridge configured to be mounted in the inside of the housing and provided with the photosensitive body; and a developer accommodating cartridge configured to be attached to the photosensitive body cartridge and accommodate developer, and wherein the process cartridge holding part includes:

a photosensitive-body cartridge holding part provided to the photosensitive body cartridge and configured to be held by a user so as to remove the photosensitive body cartridge from the housing; and a developer-accommodating cartridge holding part provided to the developer accommodating cartridge and configured to be held by a user so as to detach the developer accommodating cartridge from the photosensitive body cartridge.

2. The image forming apparatus as claimed in claim 1, wherein the process-cartridge holding part is configured such that in a state where the process cartridge is mounted in the inside of the housing, the process cartridge holding part overlaps a plane of projection which is formed by projecting the first opening in a direction toward the photosensitive body.

3. The image forming apparatus as claimed in claim 1, wherein, in a state where the developer accommodating cartridge is attached to the photosensitive body cartridge, the photosensitive-body cartridge holding part and the developer-accommodating cartridge holding part are arranged side by side in a longitudinal direction of the photosensitive body.

4. The image forming apparatus as claimed in claim 3, wherein the photosensitive-body cartridge holding part has a pair of outer ends in the longitudinal direction of the photosensitive body, and wherein the developer-accommodating cartridge holding part is configured such that in a state where the developer accommodating cartridge is attached to the photosensitive body cartridge, the developer-accommodating cartridge holding part is disposed confronting the pair of outer ends of the photosensitive-body cartridge holding part from their outer sides in the longitudinal direction of the photosensitive body.

5. The image forming apparatus as claimed in claim 3, wherein at least one of the photosensitive-body cartridge holding part and the developer-accommodating cartridge holding part includes an extension part extending in the longitudinal direction of the photosensitive body, and wherein the extension part is configured such that in a state where the process cartridge is mounted in the inside of the housing, if the extension part is seen in an orthogonal direction orthogonal to the longitudinal direction of the photosensitive body, the extension part overlaps the other one of the photosensitive-body cartridge holding part and the developer-accommodating cartridge holding part.

6. The image forming apparatus as claimed in claim 1, wherein the housing is formed with a second opening through which the process cartridge is to be mounted in and removed from the inside of the housing, wherein the housing is provided with an opening/closing member configured to move between an open position opening the second opening and a closed position closing the second opening, and wherein the opening/closing member includes a pressing part configured such that when the opening/closing member moves from the open position to the closed position, the pressing part presses the photosensitive-body cartridge holding part of the photosensitive body cartridge which is in a middle of being mounted in the housing.

7. The image forming apparatus as claimed in claim 1, wherein the housing is provided with a light shielding member disposed between the first opening and the process cartridge mounted in the housing and configured to prevent at least part of light that has entered the inside of the housing through the first opening from reaching the photosensitive body.

8. The image forming apparatus as claimed in claim 1, wherein the housing is provided with a light shielding member disposed between the first opening and the process cartridge mounted in the housing and configured to prevent at least part of light that has entered the inside of the housing through the first opening from reaching the photosensitive body.

9. The image forming apparatus as claimed in claim 8, wherein in a state where the process cartridge is mounted in the inside of the housing, the light shielding member is disposed such that if the light shielding member is seen in a direction toward the photosensitive body, the light shielding member overlaps the developer-accommodating cartridge holding part.

10. The image forming apparatus as claimed in claim 7, wherein the light shielding member includes a plurality of light shielding members which are arranged in the longitudinal direction of the photosensitive body with a gap being formed therebetween.

11. The image forming apparatus as claimed in claim 1, wherein the process cartridge holding part is disposed at one of a pair of opposite end portions of the process cartridge that is closer to the first opening than the other one of the pair is.

12. The image forming apparatus as claimed in claim 1, wherein the process cartridge holding part has a first surface that faces the first opening, a corrugated region being formed on the first surface.

13. The image forming apparatus as claimed in claim 1, wherein the process cartridge holding part has a base end at which the process cartridge holding part is connected to the process cartridge, the process cartridge holding part extending from the base end toward its distal end in an extending direction, the extending direction intersecting with a first direction that is directed from the first opening to the photosensitive body, an obtuse angle being formed between the extending direction and the first direction.

14. The image forming apparatus as claimed in claim 1, further comprising an exposing member disposed inside the housing and configured to emit a laser light to the photosensitive body so as to expose the photosensitive body to the laser light, wherein in a state where the process cartridge is mounted in the inside of the housing, the process cartridge holding part is disposed at a same side with the exposing member with respect to the photosensitive body.

15. The image forming apparatus as claimed in claim 14, wherein the process cartridge holding part has a first surface that faces the first opening and a second surface opposite to the first surface, and wherein the process cartridge holding part is configured such that in a state where the process cartridge is mounted in the inside of the housing, the first surface of the process cartridge holding part blocks at least part of light that has entered the inside of the housing through the first opening and the second surface of the process cartridge holding part allows the laser light to pass by the second surface.

16. An image forming apparatus comprising:

a housing formed with a first opening through which a recording medium is to be introduced into an inside of the housing; and a process cartridge configured to be mounted in the inside of the housing and provided with a photosensitive body, the process cartridge being provided with a process-cartridge holding part configured to be held by a user so as to remove the process cartridge from the housing, the process-cartridge holding part being configured such that in a state where the process cartridge is mounted in the inside of the housing, the process-cartridge holding part prevents at least part of light that has entered the inside of the housing through the first opening from reaching the photosensitive body, wherein the housing is provided with a light shielding member disposed between the first opening and the process cartridge mounted in the housing and configured to prevent at least part of light that has entered the inside of the housing through the first opening from reaching the photosensitive body, wherein the photosensitive body is configured to rotate relative to the housing, wherein the light shielding member has a base end at which the light shielding member is connected to the housing and a distal end, the light shielding member extending from the base end to the distal end, wherein the process cartridge holding part has a base end at which the process cartridge holding part is connected to the process cartridge, the process cartridge holding part extending from the base end to its distal end, wherein the base end of the light shielding member and the distal end of the process cartridge holding part are disposed at one side of a line segment connecting an axial center of the photosensitive body and the first opening, and the distal end of the light shielding member and the base end of the process cartridge holding part are disposed at another side of the line segment.

17. The image forming apparatus as claimed in claim 16, wherein the distal end of the light shielding member is disposed at a position closer to the process cartridge than the base end of the light shielding member is.

18. An image forming apparatus comprising:

a housing formed with a first opening through which a recording medium is to be introduced into an inside of the housing;

a process cartridge configured to be mounted in the inside of the housing and provided with a photosensitive body; and a guide part configured to guide the recording medium so as to introduce the recording medium into the inside of the housing through the first opening, the guide part being configured to prevent at least part of light that has entered the inside of the housing through the first opening from reaching the photosensitive body, the process cartridge being provided with a process-cartridge holding part configured to be held by a user so as to remove the process cartridge from the housing, and the process-cartridge holding part being configured such that in a state where the process cartridge is mounted in the inside of the housing, the process-cartridge holding part prevents at least part of light that has entered the inside of the housing through the first opening from reaching the photosensitive body.

19. The image forming apparatus as claimed in claim 18, wherein the housing is provided with a support part configured to support the guide part, the support part being configured to prevent at least part of light that has entered the inside of the housing through the first opening from reaching the photosensitive body.

* * * * *